US009586125B2

(12) United States Patent
McNeil et al.

(10) Patent No.: US 9,586,125 B2
(45) Date of Patent: Mar. 7, 2017

(54) HEAD AND NECK PROTECTION APPARATUS AND METHODS

(71) Applicant: MIOFLEX, LLC, Charlotte, NC (US)

(72) Inventors: Raeshon Lamont McNeil, Charlotte, NC (US); Jeremy Losaw, Charlotte, NC (US); Michael Starkey, Charlotte, NC (US); Juan Carlos Perez, Charlotte, NC (US); Thomas James Philpott, Charlotte, NC (US); Daniel Lee Bizzell, Charlotte, NC (US)

(73) Assignee: MIOFLEX, LLC, Charlotte, NC (US)

( * ) Notice: Subject to any disclaimer, the term of this patent is extended or adjusted under 35 U.S.C. 154(b) by 438 days.

(21) Appl. No.: 14/066,686

(22) Filed: Oct. 29, 2013

(65) Prior Publication Data

US 2017/0007908 A1 Jan. 12, 2017

Related U.S. Application Data

(60) Provisional application No. 61/720,291, filed on Oct. 30, 2012.

(51) Int. Cl.
*A63B 71/12* (2006.01)
*A63B 71/10* (2006.01)

(52) U.S. Cl.
CPC ..... *A63B 71/1291* (2013.01); *A63B 71/10* (2013.01); *A63B 71/12* (2013.01)

(58) Field of Classification Search
CPC .. A41D 13/00; A41D 13/0512; A41D 13/015; A42B 3/0473; A42B 17/03
USPC ..... 2/425, 420–422, 410, 411, 415, 468
See application file for complete search history.

(56) References Cited

U.S. PATENT DOCUMENTS

| | | | | |
|---|---|---|---|---|
| 1,532,037 | A * | 3/1925 | Cahill | A41D 13/015 2/463 |
| 3,671,974 | A | 6/1972 | Sims | |
| 3,818,509 | A | 6/1974 | Romo et al. | |
| 3,900,896 | A | 8/1975 | Ackerman | |
| 4,141,368 | A | 2/1979 | Meyer | |
| 4,219,193 | A | 8/1980 | Newman | |
| 4,224,694 | A | 9/1980 | Palmaer | |
| 4,297,994 | A | 11/1981 | Bashaw | |
| 4,319,362 | A | 3/1982 | Ettinger | |

(Continued)

FOREIGN PATENT DOCUMENTS

EP 1649903 A1 4/2006

*Primary Examiner* — Gloria Hale
(74) *Attorney, Agent, or Firm* — Tillman Wright, PLLC; Chad D. Tillman

(57) ABSTRACT

An apparatus for protecting against injuries to the head and neck includes a head harness; a body anchor component; and tensioners extending between and interconnecting the head harness and the body anchor component. The tensioners limit the range of movement of the head. Each tensioner is a composite band or strap having an elastic member and an inelastic member. An additional linking member in the connection between the tensioner and the body anchor component preferably has viscoelastic properties and cushions or dampens rapid acceleration of the tensioners during an impact to the head, such as when a tackle is made in football. The additional linking member preferably is a solid material with viscoelastic characteristics. In some embodiments, the apparatus is configured to be worn under a football helmet and shoulder pads.

20 Claims, 38 Drawing Sheets

(56) References Cited

U.S. PATENT DOCUMENTS 4,426,908 A 1/1984 Ullmann
4,638,510 A 1/1987 Hubbard
4,870,705 A 10/1989 Higby et al.
5,007,141 A 4/1991 Gentes
5,123,408 A * 6/1992 Gaines ..... A42B 3/0473 2/425
5,199,940 A 4/1993 Morris et al.
5,205,803 A 4/1993 Zemitis
5,228,454 A 7/1993 Siegler
5,261,125 A * 11/1993 Cartwright ..... A42B 3/0473 2/421
5,272,770 A * 12/1993 Allen ..... A42B 3/0473 2/421
5,287,562 A 2/1994 Rush, III
5,335,674 A 8/1994 Siegler
5,336,139 A 8/1994 Miller
5,353,437 A * 10/1994 Field ..... A41D 13/0153 2/421
5,371,905 A 12/1994 Keim
5,404,590 A 4/1995 Monica, Jr.
5,437,613 A 8/1995 Reggio et al.
5,483,698 A 1/1996 Douglas, Jr.
5,493,736 A 2/1996 Allison
5,507,707 A 4/1996 Miller
5,509,869 A 4/1996 Miller
5,517,699 A * 5/1996 Abraham, II ..... A41D 13/0512 2/205
5,551,081 A * 9/1996 Starnes et al. ..... A41D 13/0512 2/468
5,712,011 A 1/1998 McMahon et al.
5,815,846 A 10/1998 Calonge
5,930,843 A * 8/1999 Kelly ..... A42B 3/0473 2/421
5,988,173 A 11/1999 Scruggs
6,006,368 A 12/1999 Phillips
6,202,263 B1 3/2001 Harker
6,298,483 B1 10/2001 Schiebl et al.
6,385,781 B1 5/2002 Rose et al.
6,810,535 B1 * 11/2004 Moloney ..... A42B 3/0473 2/411
6,874,170 B1 * 4/2005 Aaron ..... A41D 13/0512 2/421
6,886,186 B2 5/2005 Jansen
6,968,576 B2 11/2005 McNeil et al.
6,971,123 B2 * 12/2005 Weaver ..... A42B 3/0473 2/411
7,155,747 B2 1/2007 Baker
7,402,147 B1 7/2008 Allen
7,449,005 B2 11/2008 Pickering et al.
7,794,374 B1 9/2010 Park
7,797,764 B2 9/2010 Norris
8,046,846 B2 11/2011 Karlsson et al.
8,341,770 B2 1/2013 Siegler et al.
8,528,113 B2 9/2013 Siegler et al.
8,683,612 B2 4/2014 Siegler et al.
8,990,962 B2 3/2015 Siegler et al.
2004/0117896 A1 6/2004 Madey et al.
2005/0166303 A1 * 8/2005 Aaron ..... A41D 13/0512 2/422
2007/0155600 A1 7/2007 Cunningham et al.
2008/0313791 A1 12/2008 Nagely
2010/0222716 A1 9/2010 Olsen
2010/0255964 A1 10/2010 Wang
2011/0060260 A1 3/2011 Siegler et al.
2011/0072567 A1 * 3/2011 Duhame ..... A41D 13/015 2/466
2011/0093999 A1 4/2011 Karlsson et al.
2014/0015176 A1 1/2014 Wetzel et al.

* cited by examiner

HEAD AND NECK PROTECTION APPARATUS AND METHODS

CROSS-REFERENCE TO RELATED APPLICATION

The present application is a U.S. nonprovisional patent application of, and claims the benefit under 35 U.S.C. 119(e) to, U.S. Patent Application No. 61/720,291, which is incorporated herein by reference.

COPYRIGHT STATEMENT

All of the material in this patent document is subject to copyright protection under the copyright laws of the United States and other countries. The copyright owner has no objection to the electronic reproduction by anyone of the patent document or the patent disclosure, as it appears in official governmental records but, otherwise, all other copyright rights whatsoever are reserved.

BACKGROUND OF THE INVENTION

The present invention generally relates to head and neck protection apparatus, systems and methods. Preferred implementations relate to sports safety equipment for protecting the head and neck from injuries generally resulting from impacts, such as with the ground or another person, and in particular, relate to sports safety equipment for use in tackle football.

Different technologies are known for protecting against impact injuries to the head and neck, including those encountered in sports such as football. Such technologies are disclosed, for example, in U.S. Patent Application Publication No. 2011/0060260; U.S. Pat. No. 5,371,905; U.S. Pat. No. 4,638,510; U.S. Pat. No. 4,319,362; U.S. Pat. No. 3,900,896; and U.S. Pat. No. 3,671,974.

Still additional technologies are disclosed and discussed in the background section of U.S. Pat. No. 8,341,770, which patent is hereby incorporated herein by reference.

Aspects and features of the present invention are believed to represent improvements, enhancements, and alternatives to such technologies.

SUMMARY OF THE INVENTION

The present invention includes many aspects and features. Moreover, while many aspects and features relate to, and are described in, the context of the football, the present invention is not limited to use only in such context, as will become apparent from the following summaries and detailed descriptions of aspects, features, and one or more embodiments of the present invention. For example, the present invention is applicable to other types of sports activities where impact to the head and neck are likely or possible, including for example, hockey, lacrosse, and racing sports. The present invention further is applicable to other types of activities for protecting against injuries, including bicycle and motorcycle riding.

Accordingly, in a first aspect of the invention, an apparatus includes: a head harness; a body anchor component; and tensioners extending between and interconnecting the head harness and the body anchor component.

In a feature, each tensioner comprises a composite strap.

In a feature, each tensioner comprises a composite band.

In a feature, the apparatus further includes a crank for adjusting tension in one or more tensioners.

In a feature, the head harness comprises a skull cap.

In a feature, the head harness comprises a liner.

In a feature, the body anchor component comprises a chest belt.

In a feature, the body anchor component comprises a vest.

In a feature, a majority of the tensioners are covered and not susceptible to grabbing when the apparatus is worn.

In a feature, the tensioners each comprises an elastic band or strap combined with an inelastic band or strap. The tensioners may be covered completely or partially to guard against the tensioners being grabbed. The covering may be effected by one or more sheaths or conduits that surrounds and/or encloses one or more of the tensioners, or by a cover that extends over a top of one or more of the tensioners. For instance, in the context of football, the tensioners may be at least partially covered such as by a football player when the person wearing the apparatus is tackled, for example.

In a feature, a connecting component having viscoelastic characteristics connects a tensioner to the body anchor component.

In a feature, the apparatus further includes a connecting component comprising a solid material having viscoelastic characteristics connects a tensioner to the body anchor component. An adjustable buckle preferably directly connects a tensioner and a connecting component.

The apparatus also further preferably includes an inelastic strap or band overlapping the connecting member such that the inelastic strap or band permits a limited range of movement of the connecting member so as to preclude overloading of the connecting member.

In another feature, the apparatus further includes a neck cushion.

Each tensioner preferably extends through an opening or slot defined by the neck cushion.

In another aspect, an apparatus includes: a head harness; a body anchor component; tensioners extending between and interconnecting the head harness and the body anchor component; football shoulder pads; and a football helmet. The head harness is configured to be worn under the football helmet; and the body anchor component is configured to be worn under the football shoulder pads.

In features of this aspect, the tensioners are not connected to the football helmet or to the football shoulder pads; the head harness is not connected to the football helmet or to the football shoulder pads; and the body anchor component is not connected to the football helmet or to the football shoulder pads.

In another feature, the head harness may include fasteners for attachment at points to the inside of the football helmet.

In another aspect, a sports safety apparatus for limiting injuries to the head and neck while playing football includes: a cap for placement on a head of a football player; a neck cushion for extending about a neck of the football player; and a vest for donning on the torso of the football player. The tensioners extend through slots defined in the neck cushion and interconnect the cap and vest such that tension is applied to the cap for limiting movement of the head to within a predefined range.

Another aspect comprises an apparatus as disclosed and described herein.

In another aspect, a method of protecting against injuries to the head and neck, includes the steps of: donning a head harness and body anchor component, wherein the head component is secured to a head and the body anchor component is secured to a torso; and arranging tensioners such that each tensioner extends between and interconnects, either directly or indirectly, the head harness and the body anchor component, each tensioner being tightened so as to convey an extent of tension between the head harness and the body anchor component. The head harness, body anchor component, and tensioners limit movement of the head to within predefined ranges.

Another aspect comprises a method of protecting against injuries to the head and neck as disclosed and described herein.

Additional aspects and features of the present invention are disclosed below in the detailed description section and in the drawings, and in the Appendix, which is incorporated herein by reference.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

With reference to the drawings now, FIG. 1 schematically illustrates a front view of a person wearing a safety apparatus in accordance with one or more aspects and features of the present invention.

DETAILED DESCRIPTION

Figure 2:
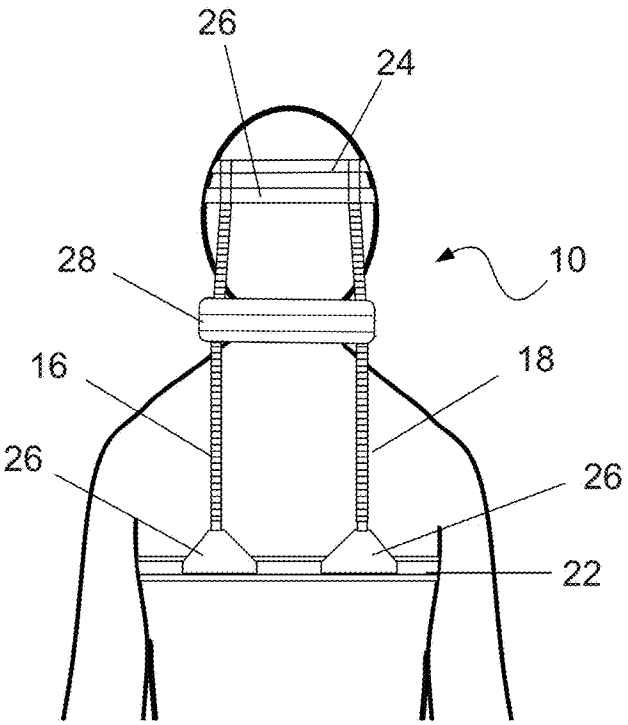
FIG. 2 schematically illustrates a back view of the person wearing the safety apparatus of FIG. 1.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 1:
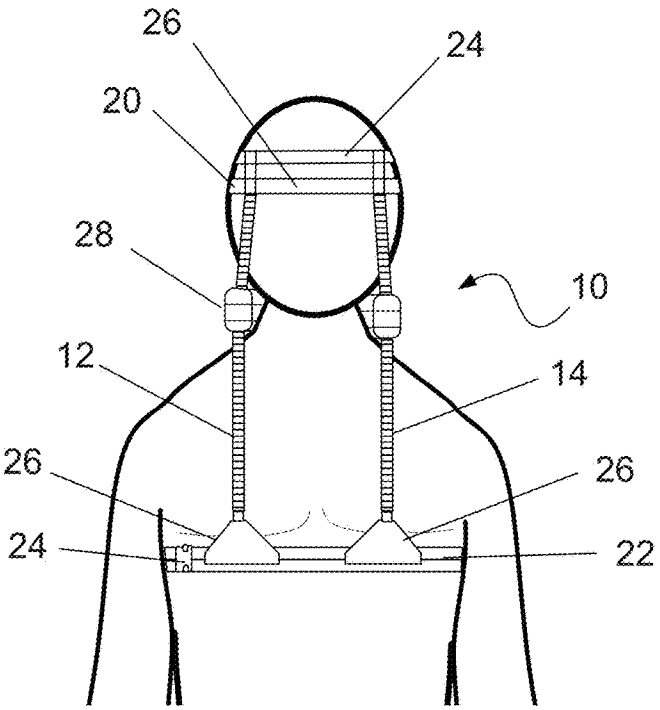

Accordingly, with reference to FIG. 1, a front view of a person wearing a safety apparatus 10 in accordance with one or more aspects and features of the present invention is schematically illustrated. Additionally, FIG. 2 schematically illustrates a back view of the person wearing the safety apparatus 10.

The safety apparatus 10 includes composite bands or straps (hereinafter generically referred to as "tensioners") attached to a head harness that limit motion of the head for protecting against head and neck injuries. In this respect, safety apparatus 10 shown in FIGS. 1-2 includes four tensioners 12,14,16,18, that extend between a head harness 20 and a body anchor component, show as a chest belt 22 in FIGS. 1-2. The head harness 20 comprises a top head band 24 and a bottom head band 26 interconnected together, each of which wraps around the head and is tightly secured thereto in a snug-fitting manner, the head harness having been pulled downward onto the skull when donned. The chest belt 22 spans the torso and is tightly secured thereto with a releasable connector, shown as a buckle 24. Connecting components 26, shown to have a trapezoidal shape in FIGS. 1-2, are attached to the chest belt 22 Each tensioner 12,14,16,18 in extending between the head harness 20 and chest belt 22 extends through a respective passageway opening formed in a neck cushion 28.

Figure 4:
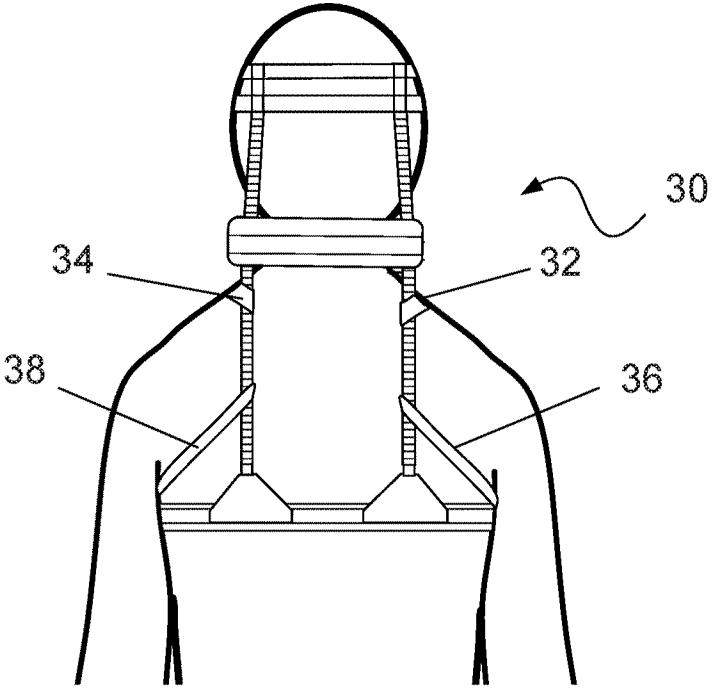
FIG. 4 schematically illustrates a back view of the person wearing the safety apparatus of FIG. 3.
Figure 3:
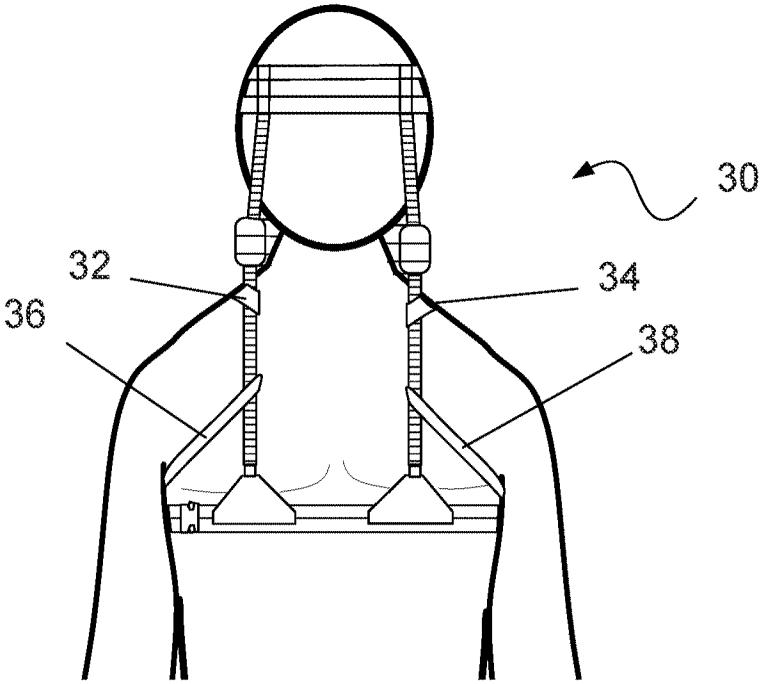
FIG. 3 schematically illustrates a front view of a person wearing another safety apparatus in accordance with one or more aspects and features of the present invention.
Figure 6:
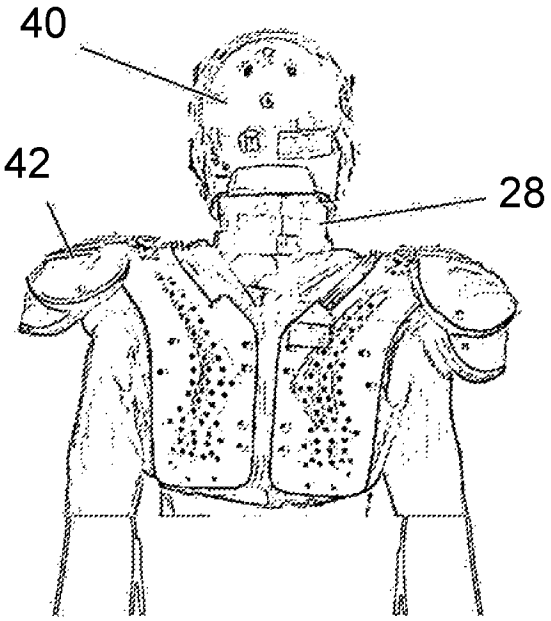
FIG. 6 schematically illustrates a back view of the person wearing the helmet, shoulder pads, and safety apparatus of FIG. 5.
Figure 5:
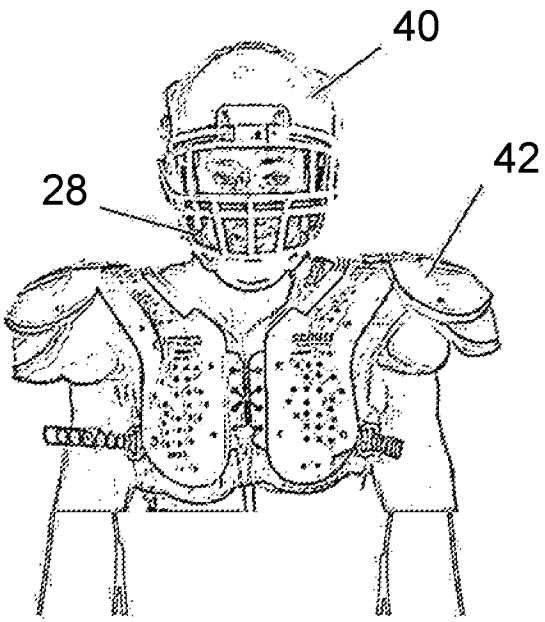
FIG. 5 schematically illustrates a front view of a person wearing a safety apparatus in accordance with one or more aspects and features of the present invention, wherein a football helmet and shoulder pads also are worn, and wherein the safety apparatus is worn under the helmet and the shoulder pads.
Figure 8:
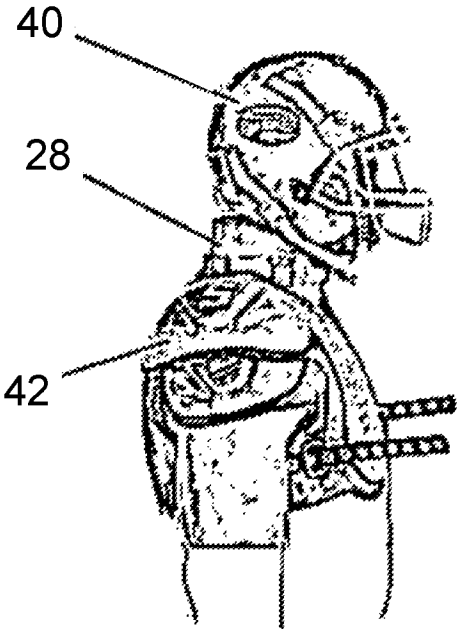
FIG. 8 schematically illustrates a second side view of the person wearing the helmet, shoulder pads, and safety apparatus of FIG. 5.
Figure 7:
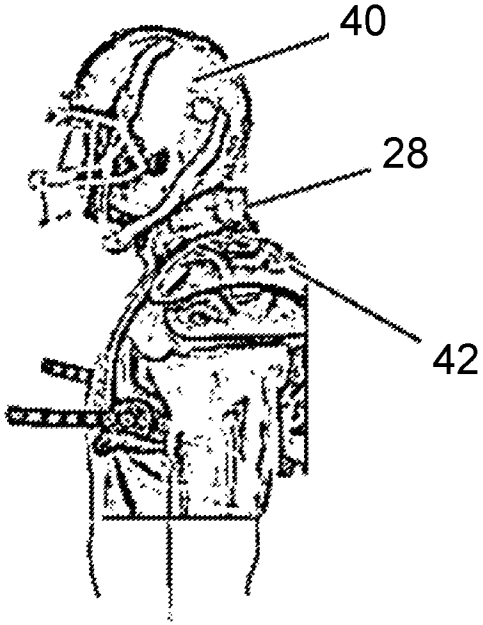
FIG. 7 schematically illustrates a first side view of the person wearing the helmet, shoulder pads, and safety apparatus of FIG. 5.

A variation of the safety apparatus 10 is represented by the safety apparatus 30 schematically illustrated in FIGS. 3-4. The structure of safety apparatus 30 is the same as that of safety apparatus 10 except that four tensioner supports 32,34,36,38 are provided. Tensioner support 32 is attached to and extends over the shoulder between tensioners 12,18; and tensioner support 34 is attached to and extends over the shoulder between tensioners 14,16. Tensioner support 36 is attached to and extends under the arm between tensioners 12,18; and tensioner support 38 is attached to and extends under the arm between tensioners 14,16. Tensioner supports 32,34,36,38 provide positioning support of the tensioners 12,14,16,18 on the body during use of the safety apparatus 30. Each tensioner support 12,14,16,18 is attached to the respective tensioners by way of a loop that extends around the respective tensioner whereby the tensioner may slide through the loop attachment. Alternatively, then end of each tensioner support may be fixedly attached to the respective tensioner, such as for example, by stitching or otherwise permanently affixing the end to the tensioner support to the tensioner.

Each of the safety apparatus 10,30 is intended to be sports protection equipment that is worn under a football helmet and shoulder pads and. A person wearing safety apparatus 30 under a football helmet 40 and shoulder pads 42 is illustrated in FIGS. 5-8.

Figure 9:
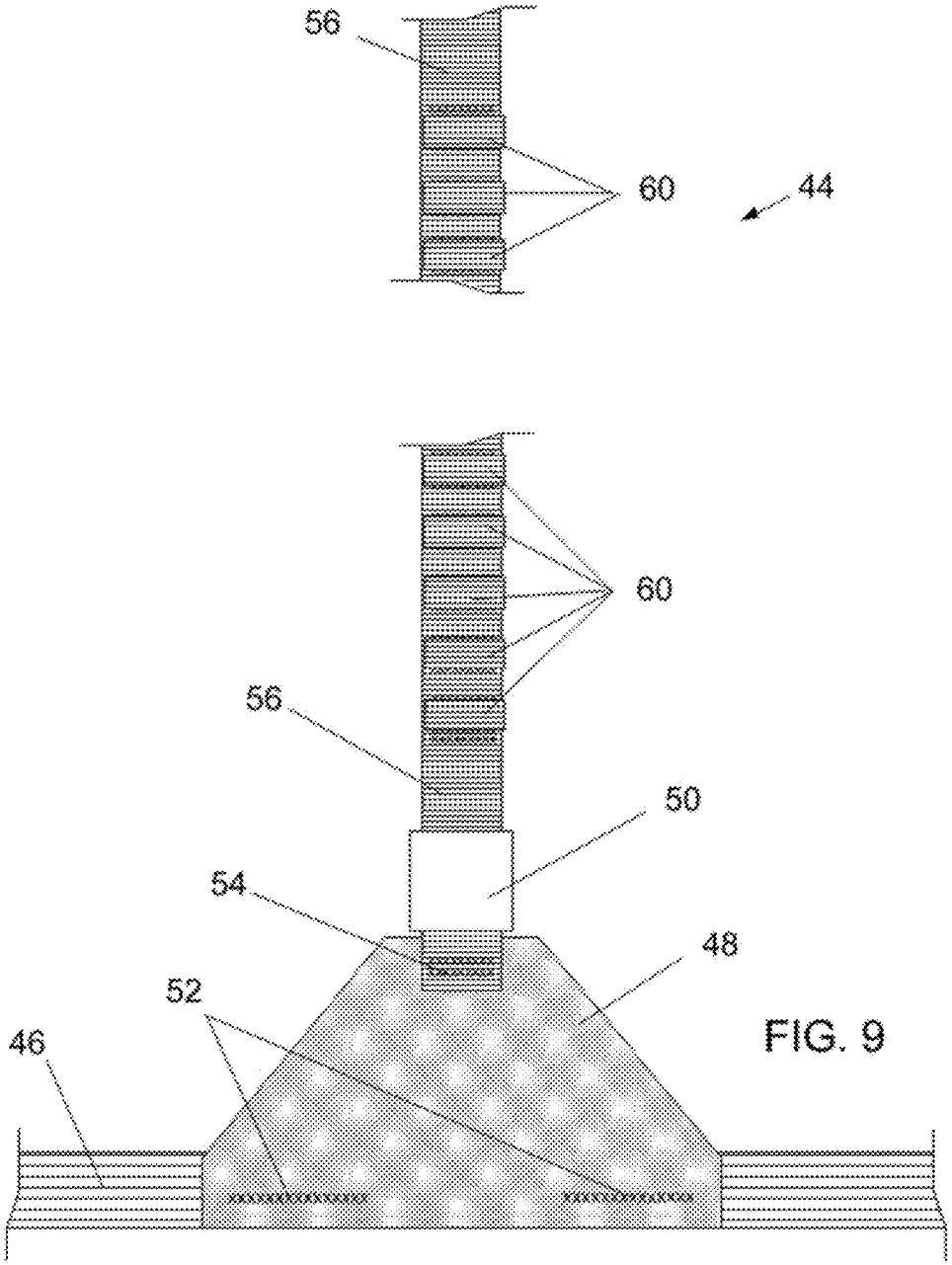
FIG. 9 schematically illustrates components of a safety apparatus in accordance with one or more aspects and features of the present invention in a first state.

FIG. 9 schematically illustrates a tensioner 44, a chest belt 46, trapezoidal connecting component 48, and buckle 50 of a safety apparatus in accordance with one or more aspects and features of the present invention. Such a safety apparatus is representative of each of safety apparatus 10,30, for example. Moreover, these components 44,46,48,50 are shown to be in a first state (i.e., the tensioner 44 is in a first state of tension).

As illustrated in FIG. 9, the trapezoidal connecting component 48 is permanently affixed to the chest belt 46 by stitching, which is represented at 52. In turn, the connecting component 48 and tensioner 44 are releasably secured together by buckle 50. Preferably, buckle 50 is a cam buckle and includes a small strap portion affixed to the connecting member at stitching at 54. An end portion of the tensioner 44 extends through and is retained within the buckle 50 when the buckle is in the locked position. When in an unlocked position, the end portion of the tensioner 44 may be further extended through, or withdrawn from, the buckle 50 for adjusting tension in the tensioner 44 in the first state.

Figure 13:
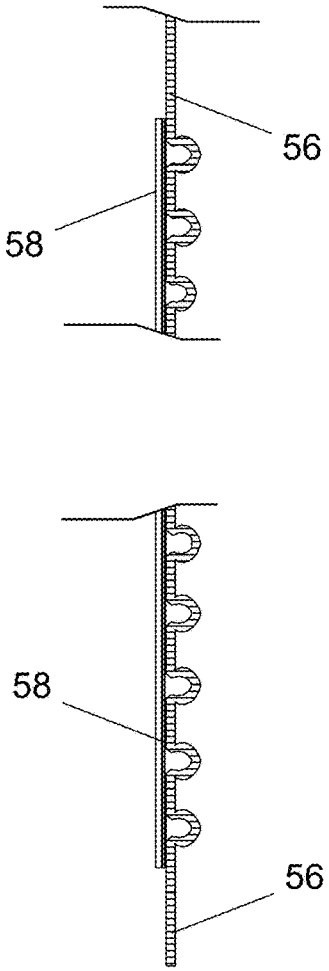
FIG. 13 schematically illustrates a side view of the composite strap of the safety apparatus of FIG. 9 in the first state.
Figure 14:
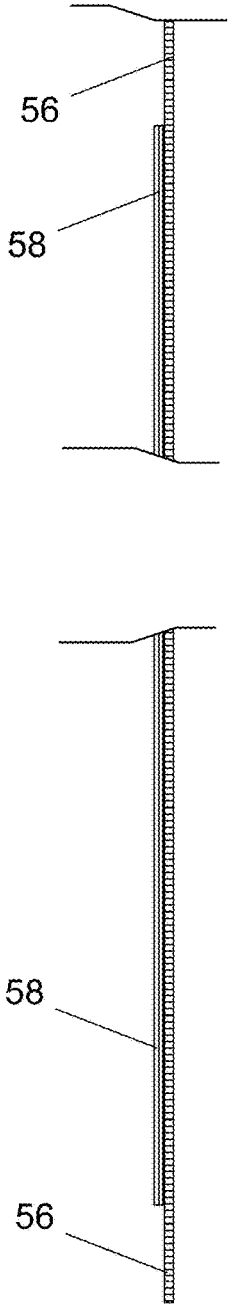
FIG. 14 schematically illustrates a side view of the composite strap of the safety apparatus of FIG. 9 in the second state.

The tensioner 44, which preferably is representative of the four tensioners of safety apparatus 10,30, comprises a composite strap or band. In this respect, the tensioner 44 comprises a generally inelastic strap or band 56 combined with an elastic strap or band 58 (perhaps best shown in FIGS. 13-14, with the composite band length at $L_3$ in FIG. 13 and at $L_3$+(n*x) in FIG. 14). The inelastic band 56 is generally bunched to form curved segments 60, with the ends of each segment being permanently affixed, such as through stitching, to the elastic band 58. In this manner, tensioner 44 preferably is capable of stretching by way of elastic band 58 up to a length corresponding to the length of the inelastic band 56, which limits expansion of elastic band 58. At this point, inelastic band preferably greatly decreases, or eliminates, the ability of the tensioner 44 to further expand and, moreover, preferably reinforces and provides greater strength to tensioner 44 beyond what the elastic band 58 alone might provide.

Figure 10:
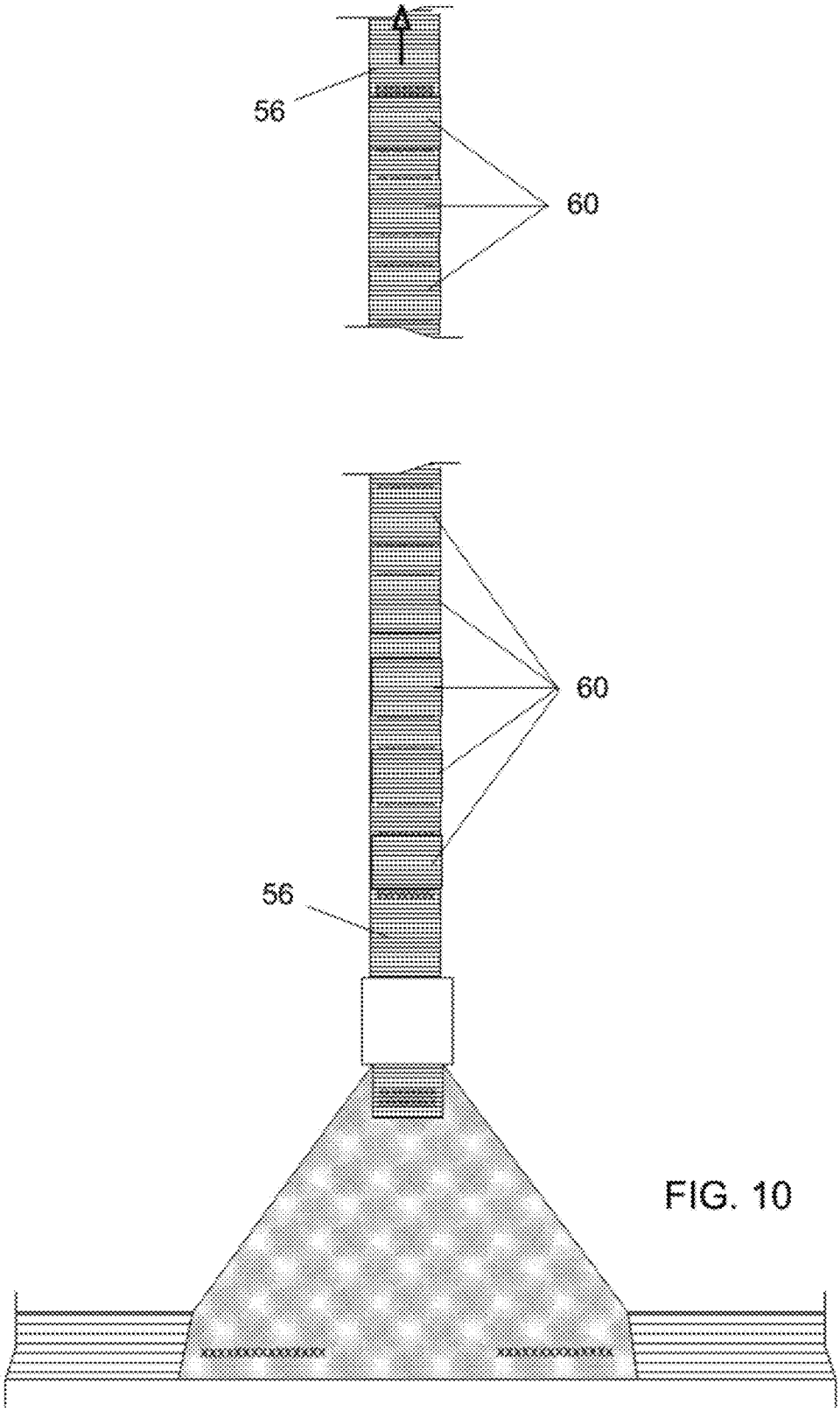
FIG. 10 schematically illustrates components of the safety apparatus of FIG. 9 in a second state in which tension is applied in a composite strap of the apparatus in an upwardly direction as represented by the arrow shown in FIG. 10.
Figure 11:
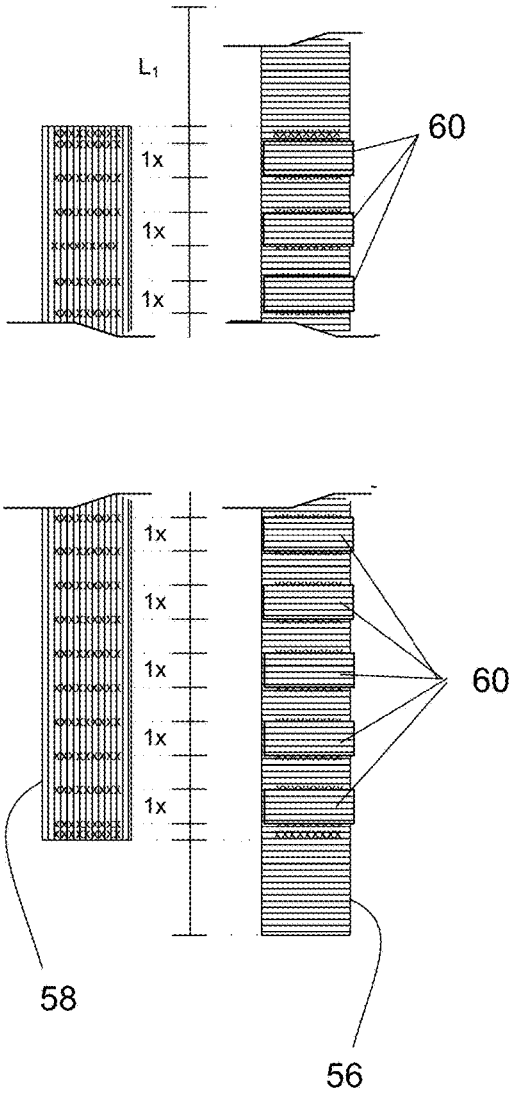
FIG. 11 schematically illustrates the composite strap of the safety apparatus of FIG. 9 in the first state, including a view of the component elastic band of the composite strap.
Figure 12:
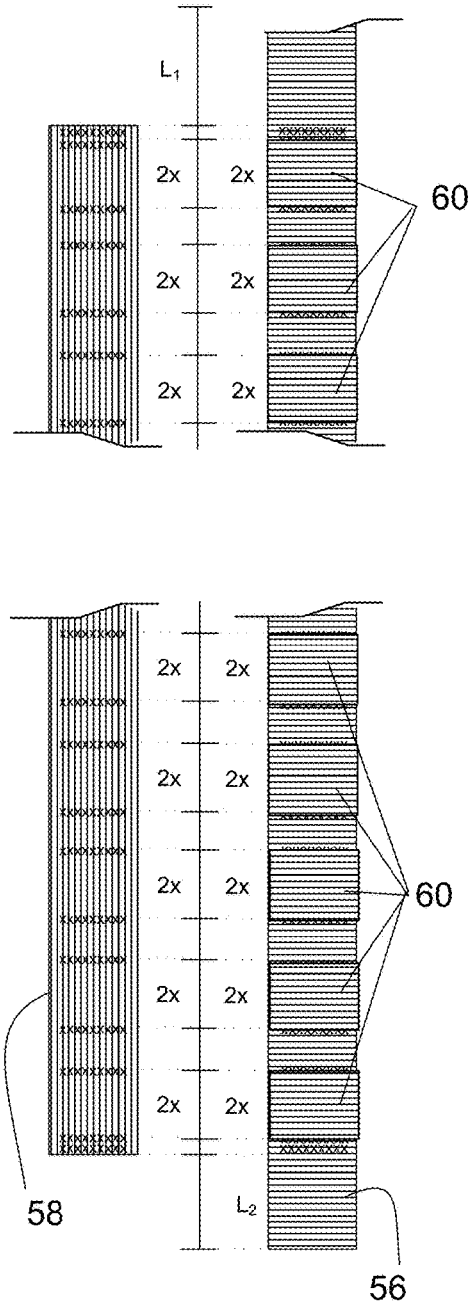
FIG. 12 schematically illustrates the composite strap of the safety apparatus of FIG. 9 in the second state, including a view of the component elastic band of the composite strap.

FIG. 10 schematically illustrates the components 44,46, 48,50 in a second state in which tension in tensioner 44 is greater than that as shown in FIG. 9. The greater tension applied results from pulling of the tensioner 44 in the direction of the arrow shown in FIG. 10. The stretching and relations between the inelastic band 56 and elastic band 58 are further illustrated in FIGS. 11-12. Specifically, in FIG. 11 the elastic band is at length $L_0$ and the inelastic band, to which the elastic band is attached, has a length $L_2$. The composite band length is $L_3$, with the inelastic band having a total of 'n' segment loops of length '2x'. In FIG. 12, the elastic band is stretched to a length $L_0$+(n*x), with the inelastic band remaining at length $L_2$. The composite band length is $L_3$+(n*x).

Additionally, as illustrated in FIG. 10, it will be appreciated that connecting component 48 itself stretches when tensioner 44 is pulled upward. In this respect, connecting component 48 preferably comprises a solid material that exhibits viscoelastic characteristics. In this regard, "solid" means that the material does not require a container to hold the material of the connecting component 48, such as would be the case if a non-solid material, such as a liquid or gel, were used for providing the viscoelastic properties. Use of viscoelastic material to form the connecting component 48 is believed to damper the expansion of tensioner 44 upon a sudden application of force accelerating the tension 44 upwardly. Preferably, the material is an elastomeric material.

Figure 15:
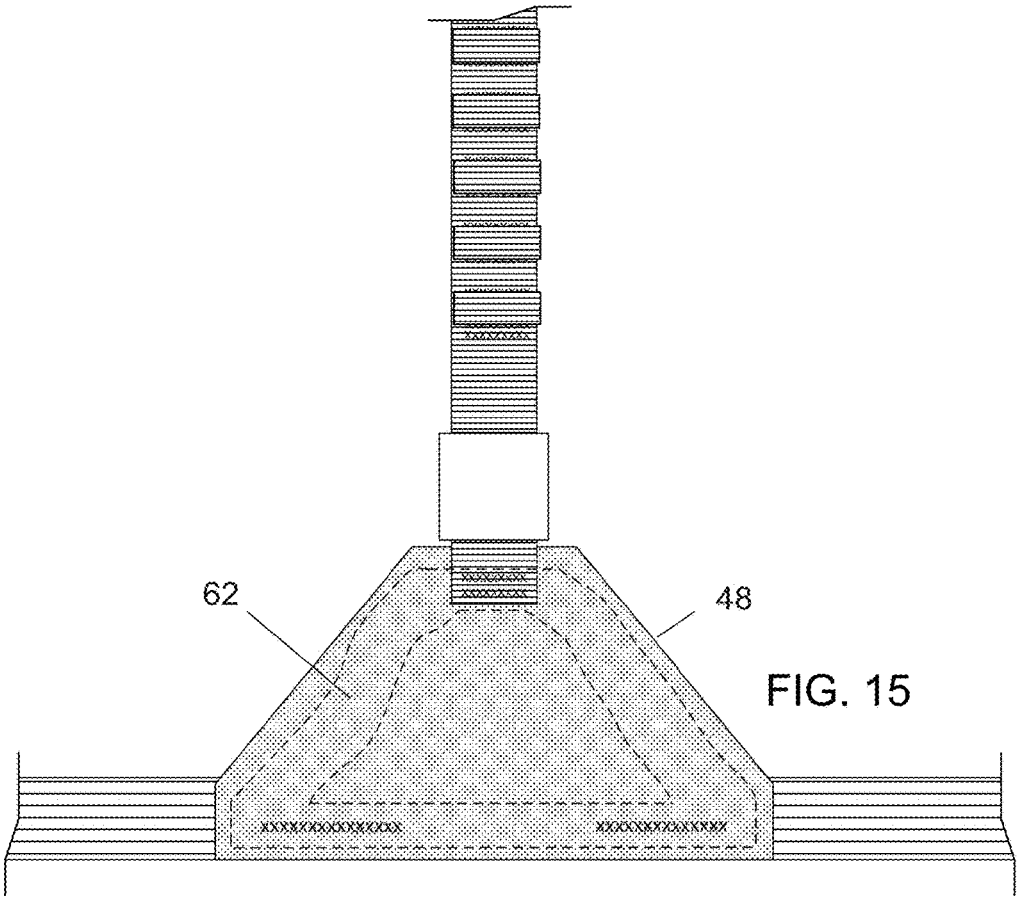
FIG. 15 schematically illustrates components of a safety apparatus in accordance with one or more aspects and features of the present invention in a first state.
Figure 16:
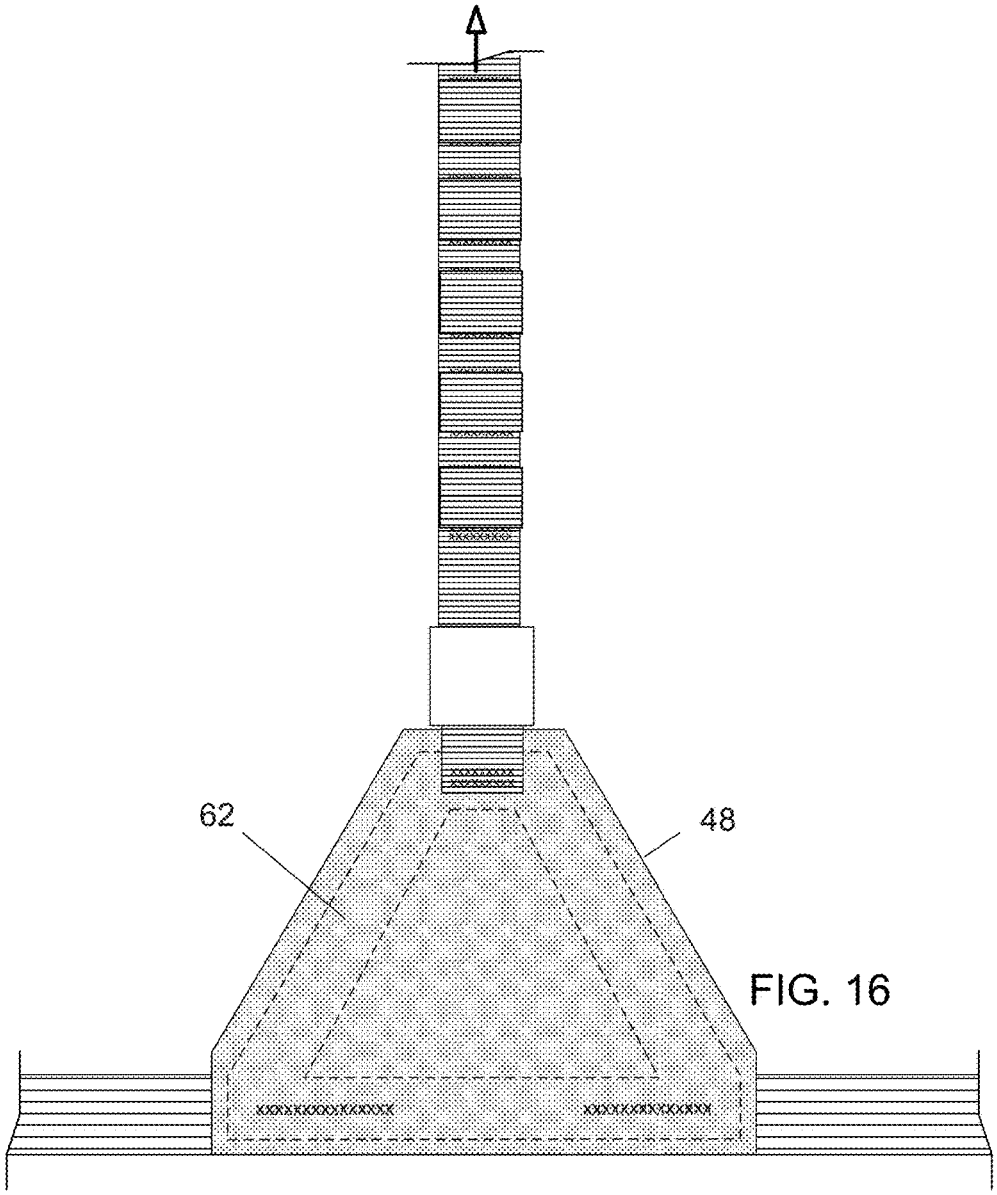
FIG. 16 schematically illustrates components of the safety apparatus of FIG. 15 in a second state in which tension is applied in a composite strap of the apparatus in an upwardly direction as represented by the arrow shown in FIG. 16.

FIG. 15 schematically illustrates components similar to those shown in FIG. 9, except that an additional component for supporting the connecting component 48 is provided, which is in the form of a generally inelastic strap 62 sewn on the backside of the connecting component 48. The strap 62 is relaxed in the first state and does not inhibit stretching of the connecting component 48; however, as shown in FIG. 16, once stretched a certain amount, the strap 62 is pulled taut and inhibits further stretching of the connecting component 48.

Figure 17:
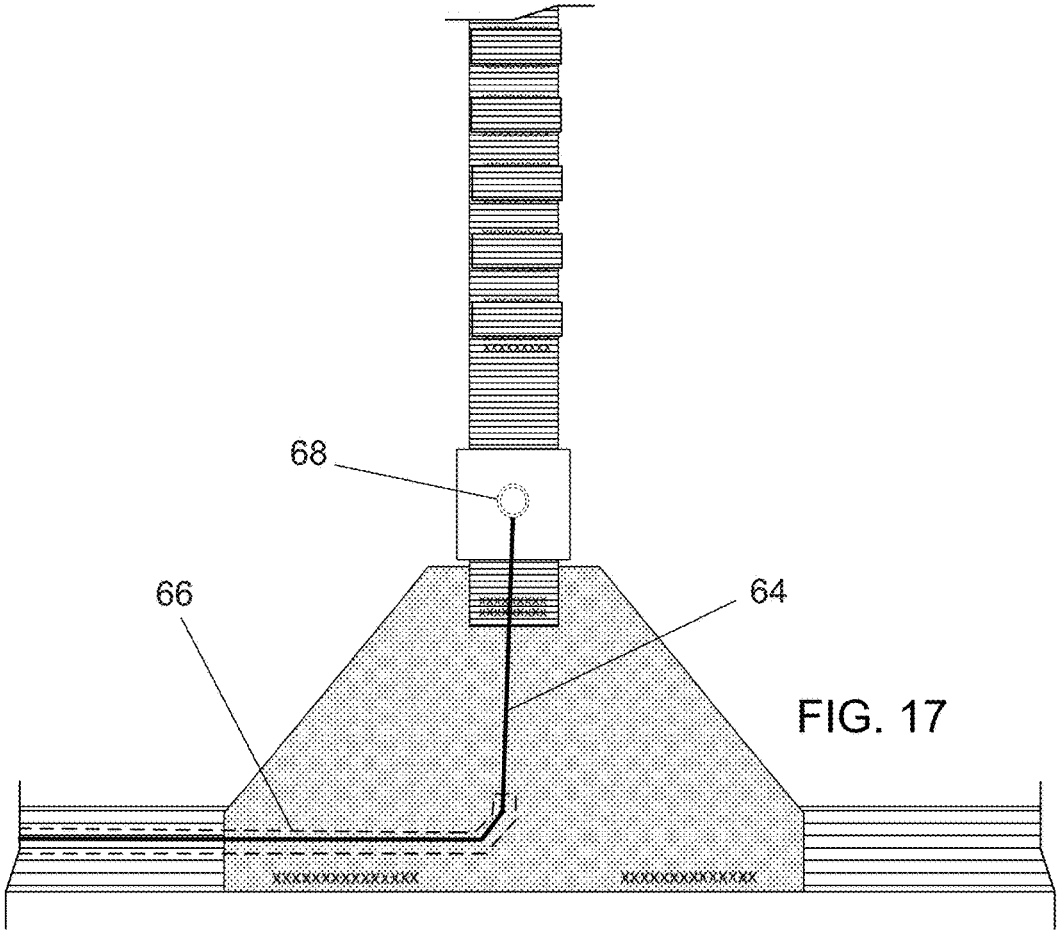
FIG. 17 schematically illustrates components of a safety apparatus in accordance with one or more aspects and features of the present invention, wherein the safety apparatus includes a cable attached to a buckle for selective tensioning of the strap via a crank of the safety apparatus.
Figure 19:
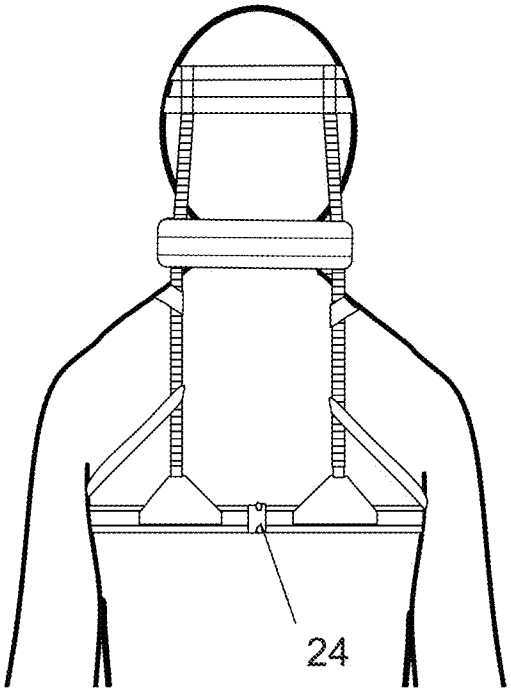
FIG. 19 schematically illustrates a back view of the person wearing the safety apparatus of FIG. 18.

FIG. 17 schematically illustrates components similar to those shown in FIG. 9, except that a tensioning cable 64 is shown extending along the chest belt within a cable conduit 66, and extending from an opening of the cable conduit 66 upwardly to the buckle to which a distal end of the cable 64 is attached at 68. The cable conduit 66 may be formed by stitching a layer of material to the chest belt. The cable 64 preferably is operable via a crank (described below with reference to FIGS. 18-19) for applying selective tension in the composite band for adjusting the fit of a safety apparatus when the components are in the first state. Use of a crank permits small incremental adjustment in tension in the safety apparatus and, thus, is believed to provide greater adjustment and better fit when the safety apparatus is donned as opposed to merely using the buckles to reposition the composite bands relative to the chest belt.

Figure 18:
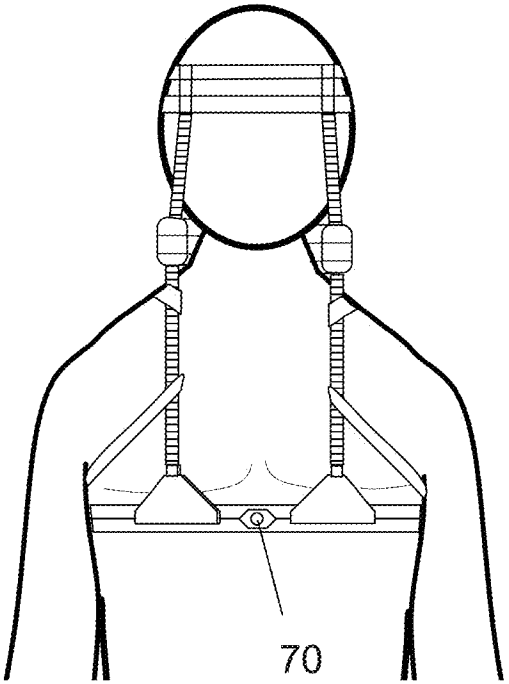
FIG. 18 schematically illustrates a front view of a person wearing a safety apparatus in accordance with one or more aspects and features of the present invention, which safety apparatus includes the components of FIG. 17, wherein the safety apparatus includes a crank for selective adjustment of tension in the safety apparatus.

The crank preferably is located on the front side of a safety apparatus, as illustrated at 70 in FIG. 18. The crank is thereby easily reachable for operation by a wearer of the safety apparatus. Moreover, four cables preferably extend within respective cable conduits from the crank to a respective one of the four connecting components and respective tensioners. As such, a releasable connector 24 on the chest belt preferably is located in between the two connecting components on the backside of the vest whereat no cable conduit extends. While there are many cranks that may be used for selectively adjusting the tension in the four tensioners, cranks in accordance with those disclosed in U.S. Pat. No. 7,516,914 (and each patent and patent application publication claiming priority to the application issuing as the '914 patent) preferably are used, which '914 patent and the related references are incorporated by reference herein. In such cranks, rotation of a control knob in one direction adjusts the tension in a pair of cables, and rotation of the same control knob in an opposite direction adjusts the tension in the other pair of cables.

It will further be appreciated that the crank may operate four cables, each of which is used to adjust tension in the tensions, or may operate only two cables for adjusting tension in two tensioners. For example, the crank may adjust tension only in the tensions of the front of the safety apparatus.

Figure 20:
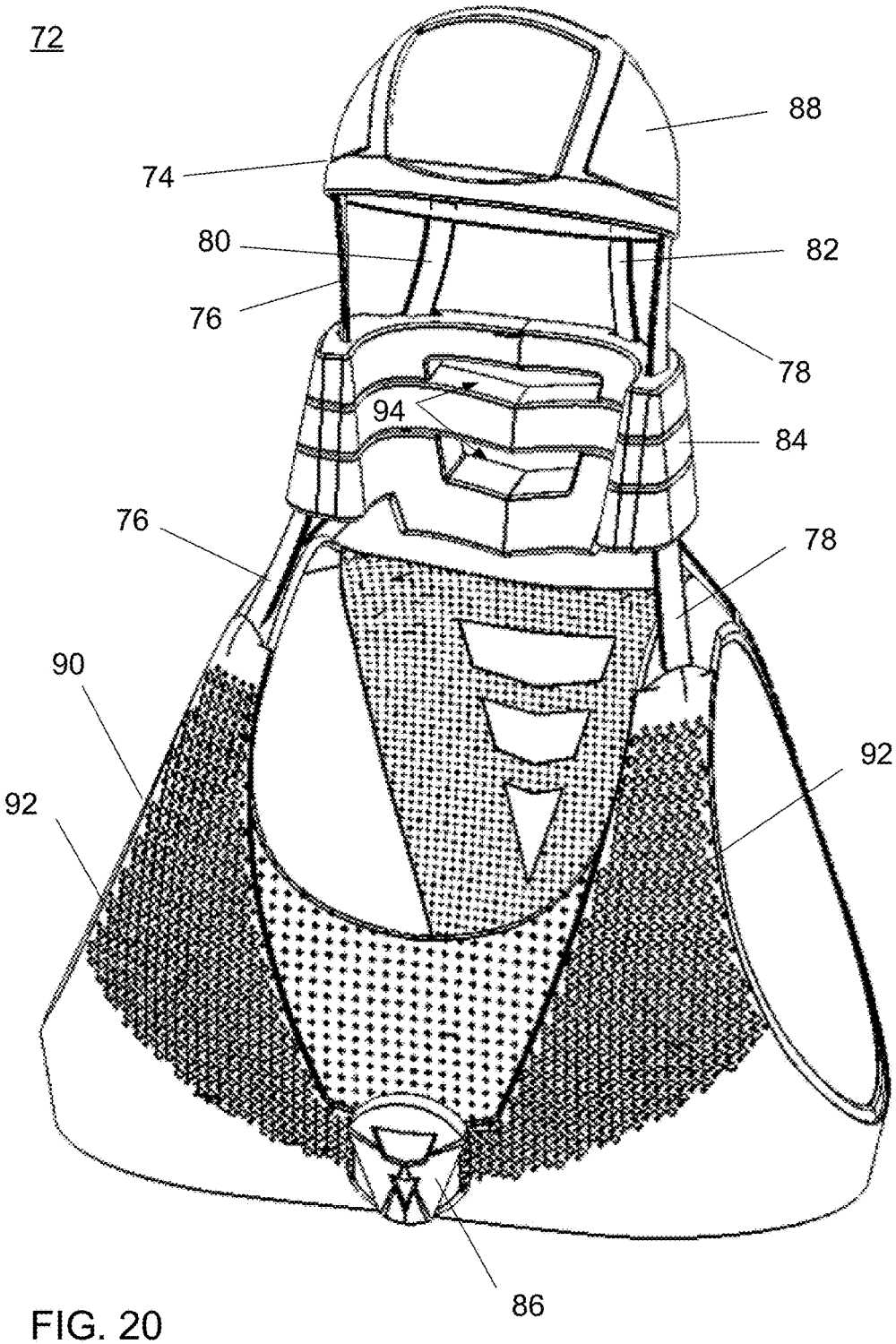
FIG. 20 schematically illustrates a generally isometric view of a safety apparatus in accordance with one or more aspects and features of the present invention.
Figure 21:
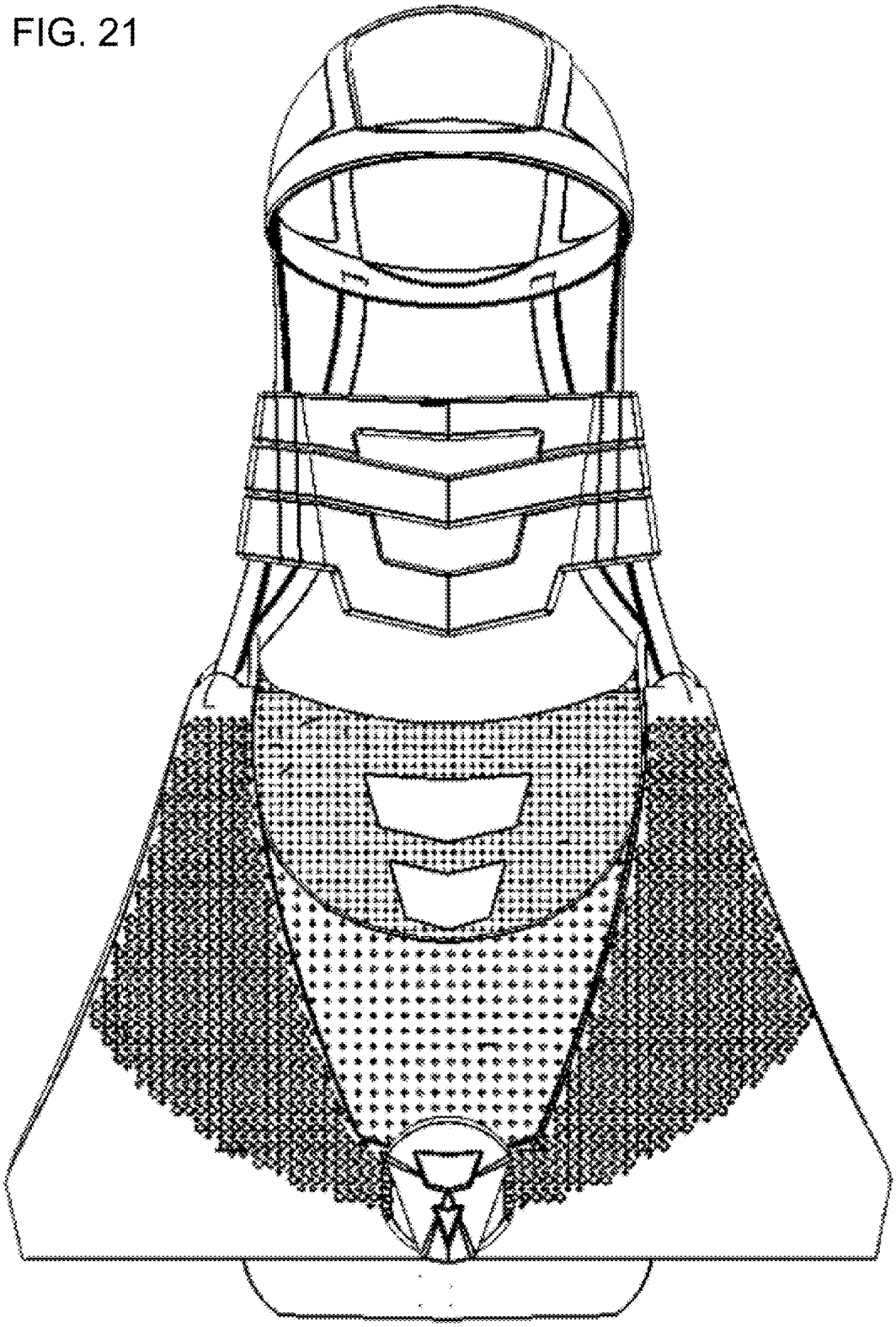
FIG. 21 schematically illustrates a front view of the safety apparatus of FIG. 20.
Figure 22:
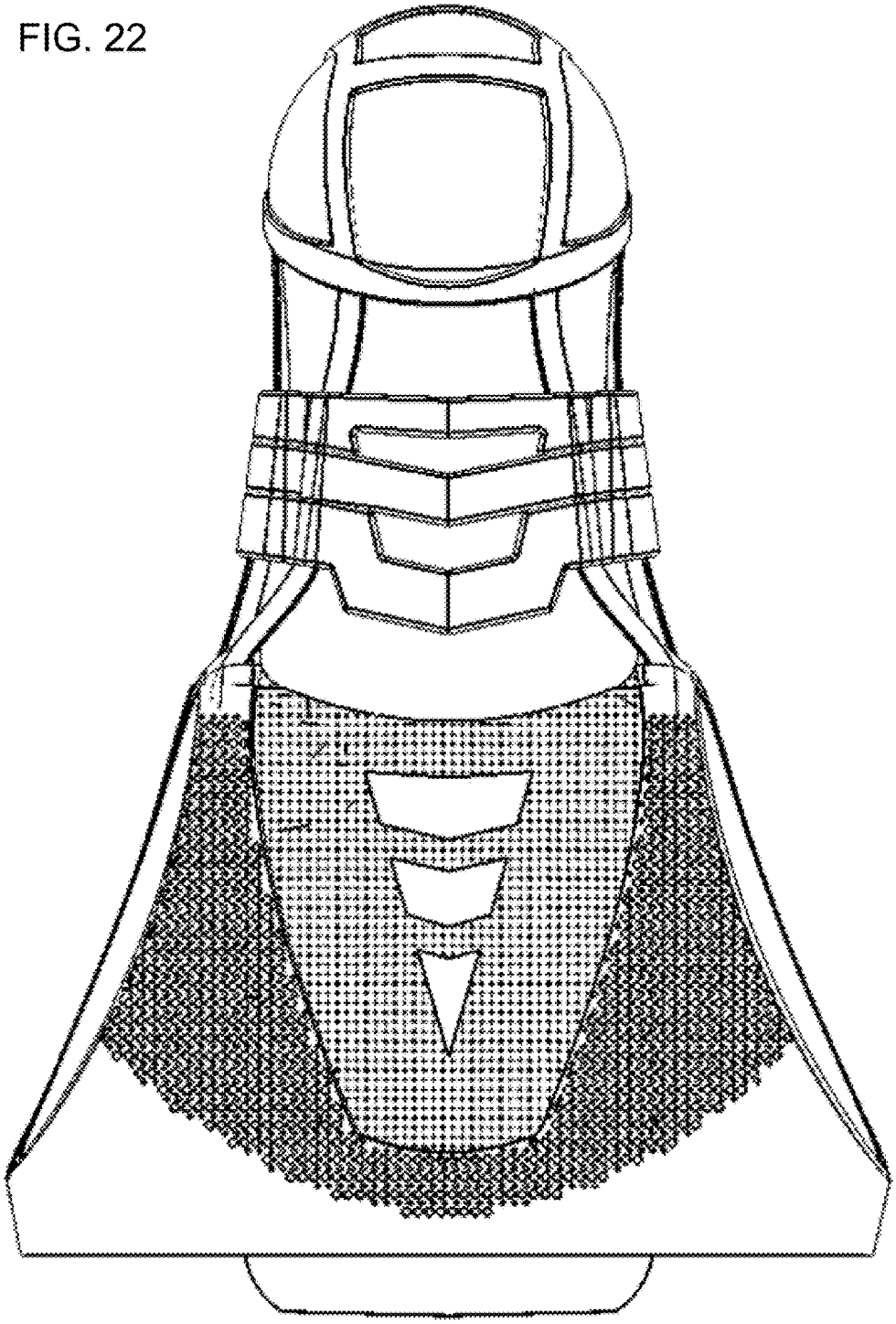
FIG. 22 schematically illustrates a rear view of the safety apparatus of FIG. 20.
Figure 23:
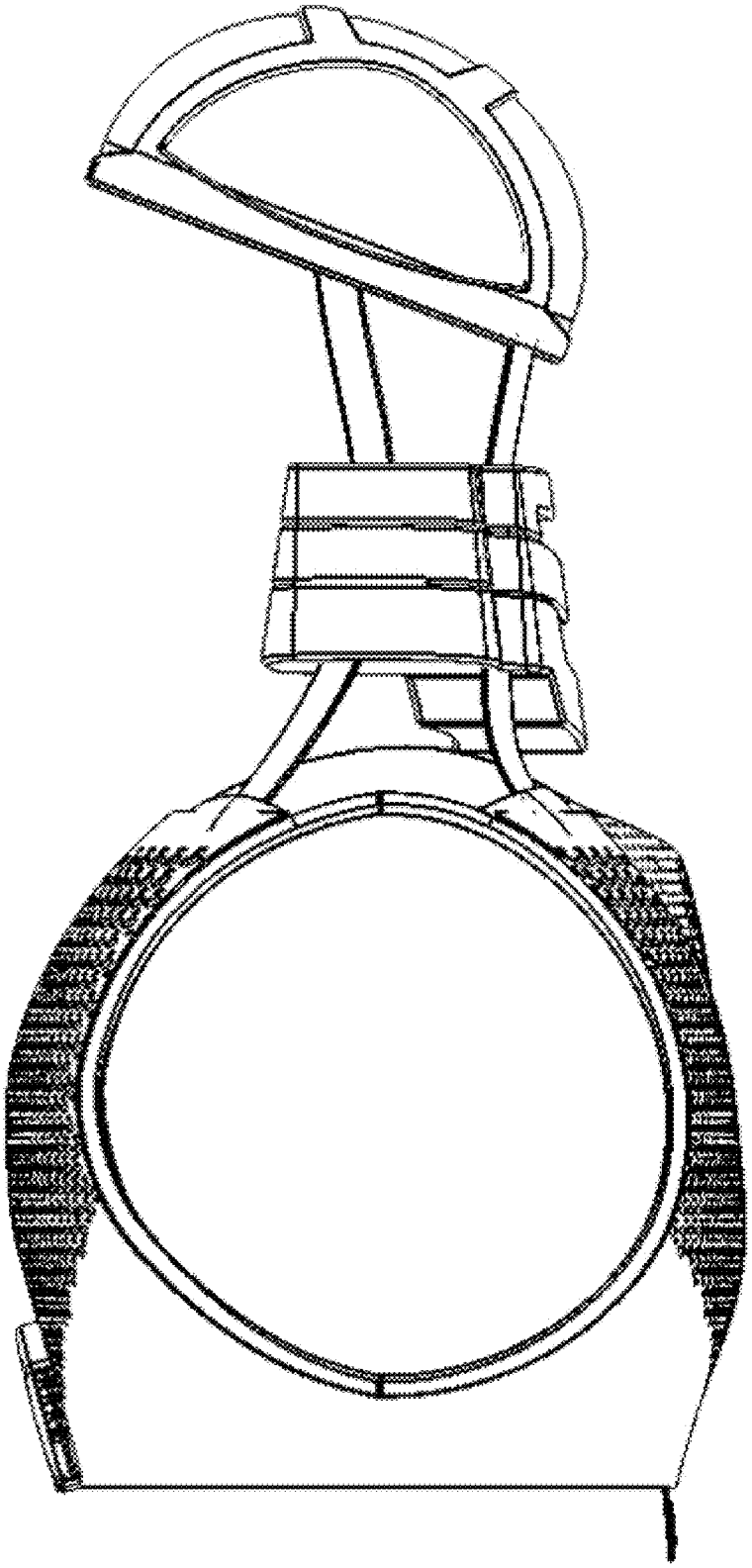
FIG. 23 schematically illustrates a first side view of the safety apparatus of FIG. 20.
Figure 24:
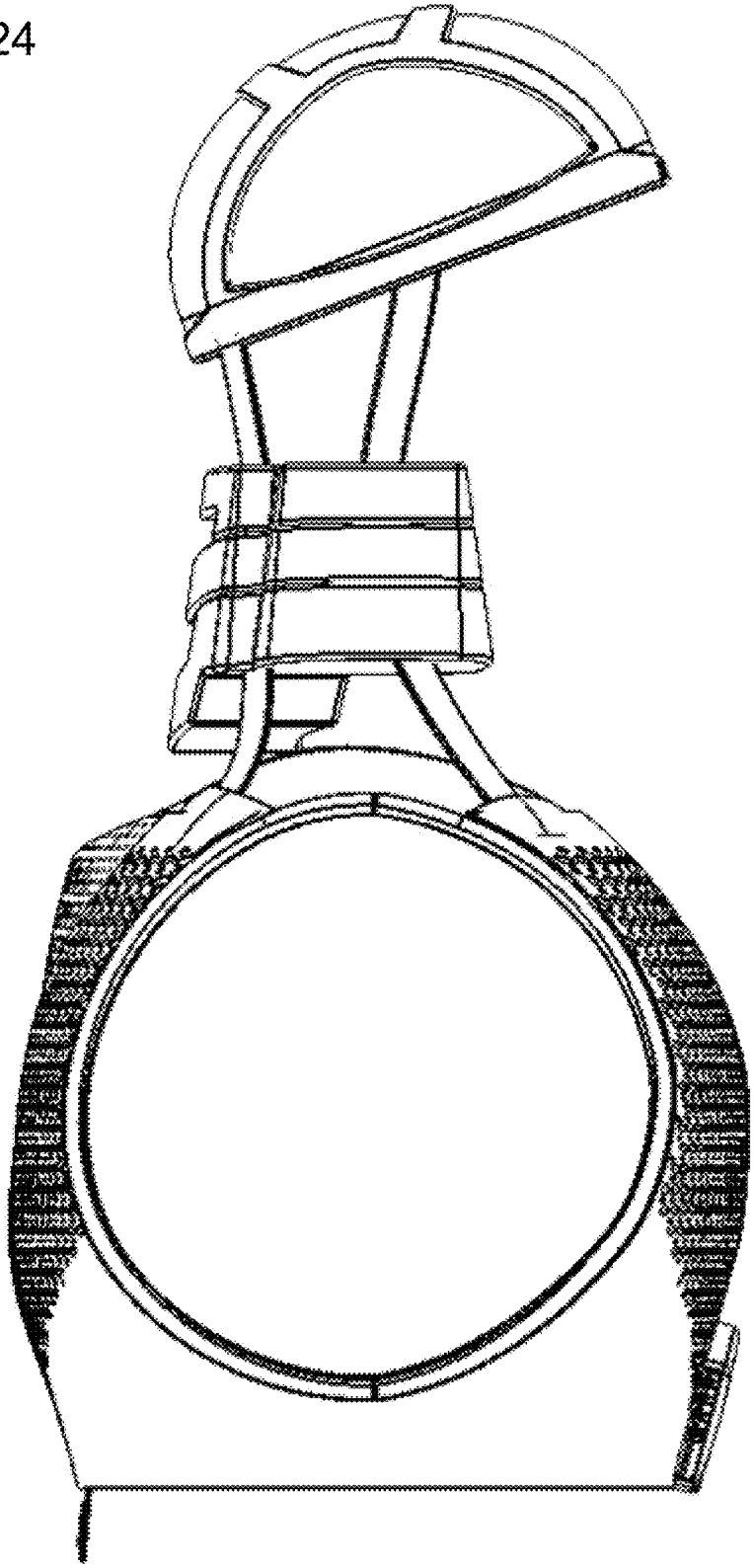
FIG. 24 schematically illustrates a second, opposite side view of the safety apparatus of FIG. 20.
Figure 25:
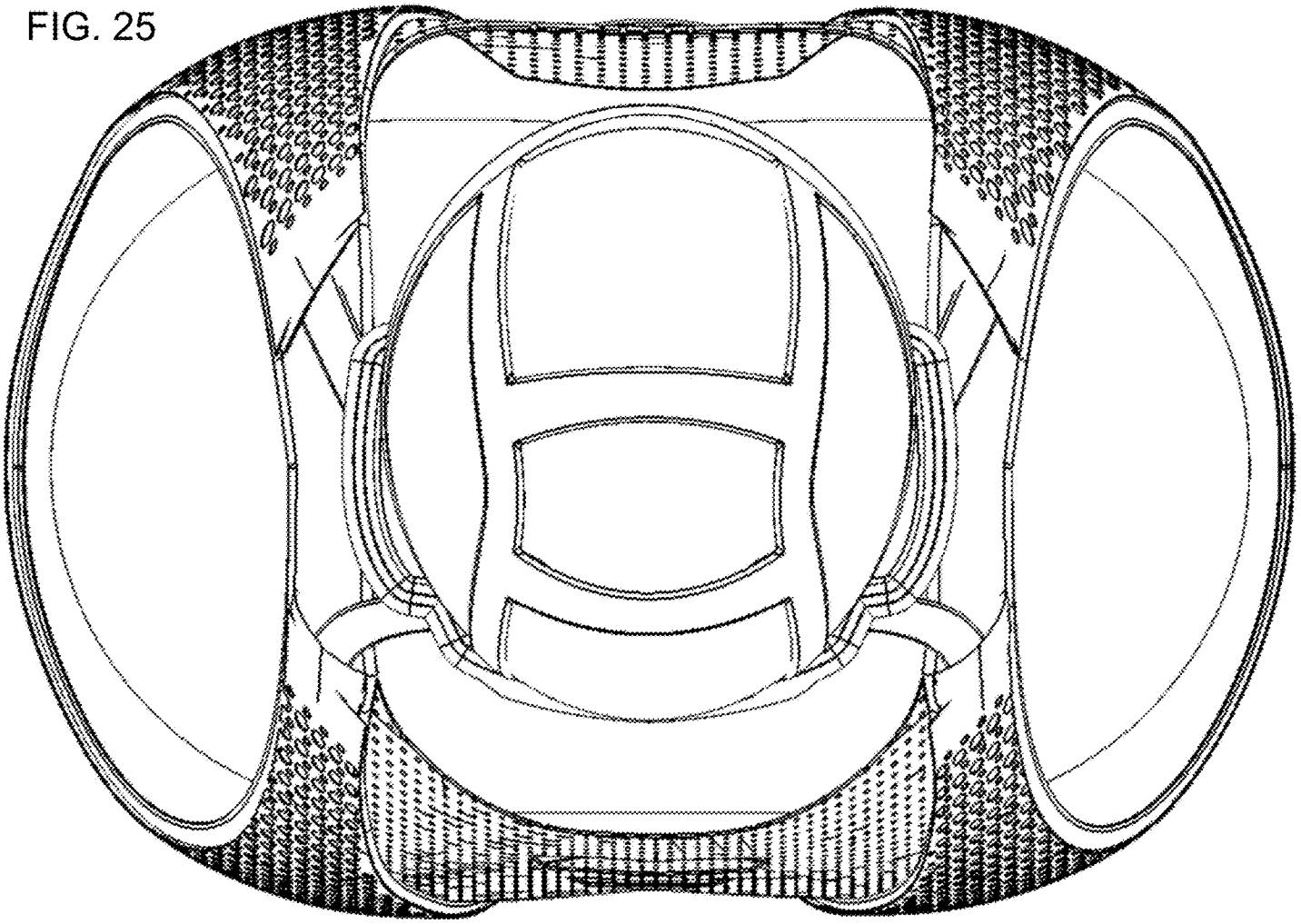
FIG. 25 schematically illustrates a top view of the safety apparatus of FIG. 20.
Figure 26:
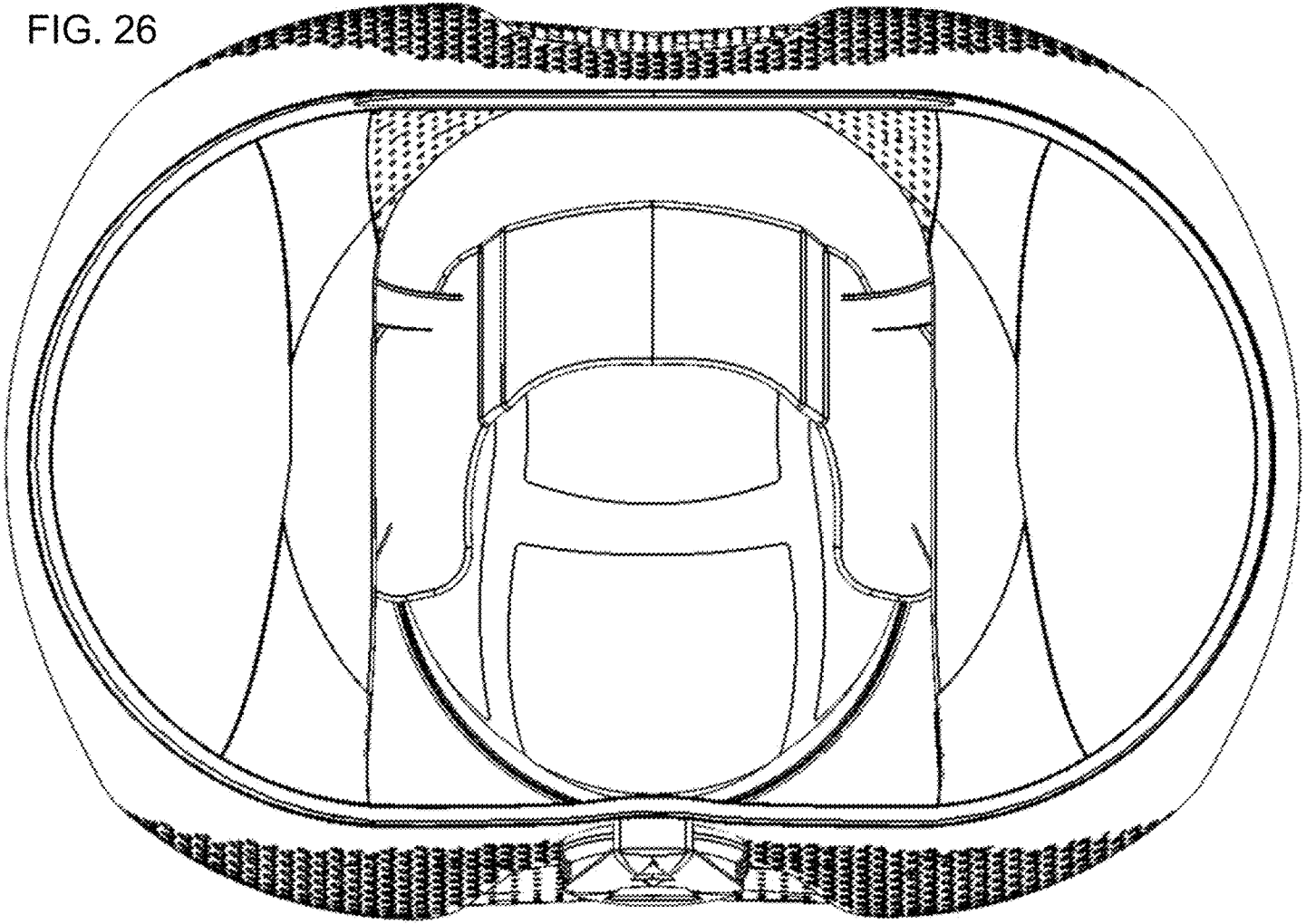
FIG. 26 schematically illustrates a bottom view of the safety apparatus of FIG. 20.

FIG. 20 schematically illustrates a generally isometric view of a safety apparatus 72 in accordance with one or more aspects and features of the present invention. Additionally, FIG. 21 schematically illustrates a front view of the safety apparatus 72; FIG. 22 schematically illustrates a rear view of the safety apparatus 72; FIG. 23 schematically illustrates a first side view of the safety apparatus 72; FIG. 24 schematically illustrates a second, opposite side view of the safety apparatus 72; FIG. 25 schematically illustrates a top view of the safety apparatus 72; and FIG. 26 schematically illustrates a bottom view of the safety apparatus 72.

The illustrated safety apparatus 72 comprises a head harness 74 (sometimes referred to herein as a "skull cap cradle"); tensioners 76,78,80,82 (sometimes referred to herein as "range of motion limiting members" or "ROM limiting members"); neck cushion 84 (sometimes referred to herein as "ROM limiting/force mitigating foam pads); and a crank 86 (sometimes referred to herein as a "dual direction ROM limiting member adjustment crank").

The safety apparatus 72 is similar to the safety apparatus described above; however, the safety apparatus 72 does differ in some respects. First, the head harness 74 includes a liner 88. Second, the safety apparatus 72 comprises a vest 90 for anchoring of the tensioners and head harness to the torso, rather than a chest belt. The vest 90 itself preferably comprises a dri-fit breathable material and includes surfaces 92 for frictional abutment therewith of shoulder pads. Third, the neck cushion 84 defines openings 94 there through for accommodating some extent of compression and greater range of motion of the neck cushion than would be the case if the openings 94 were not provided.

Figure 27:
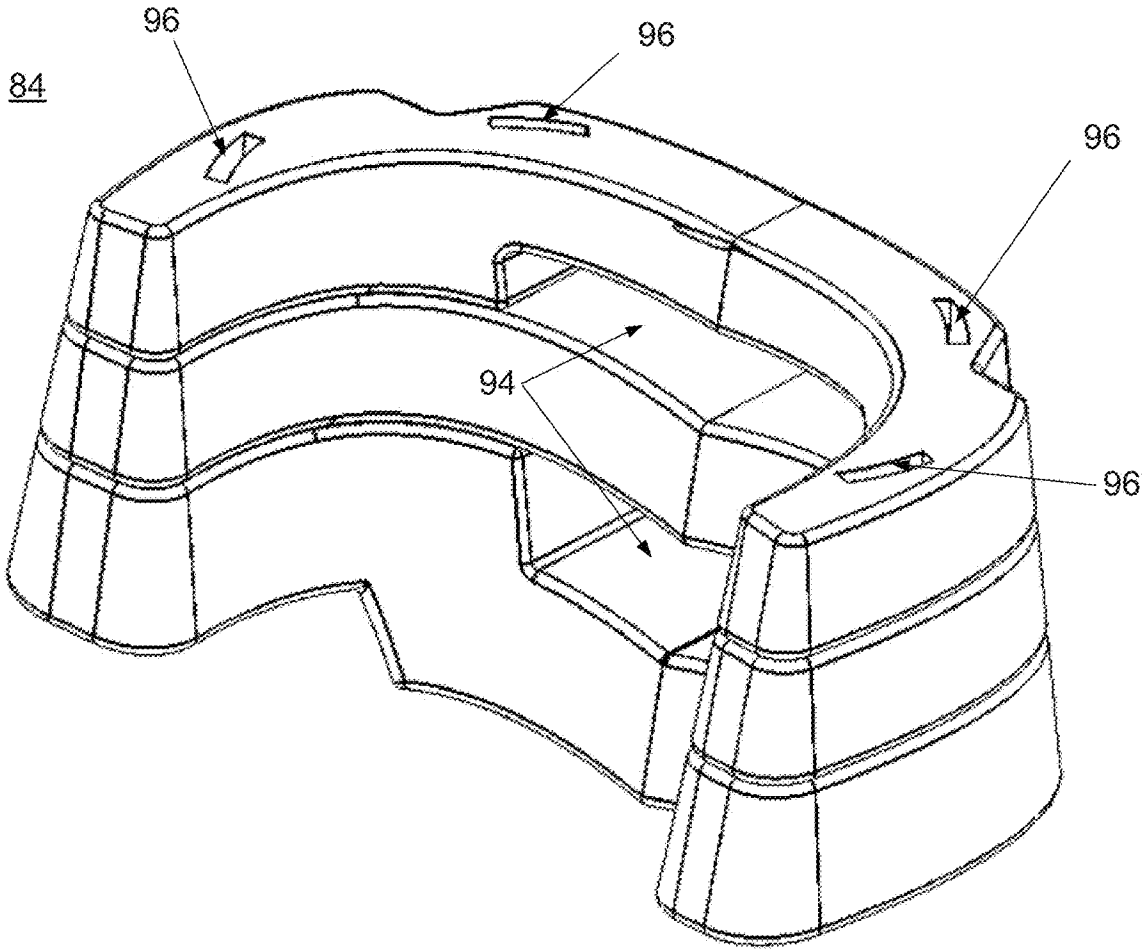
FIG. 27 schematically illustrates a view of a front of components of the safety apparatus of FIG. 20.
Figure 28:
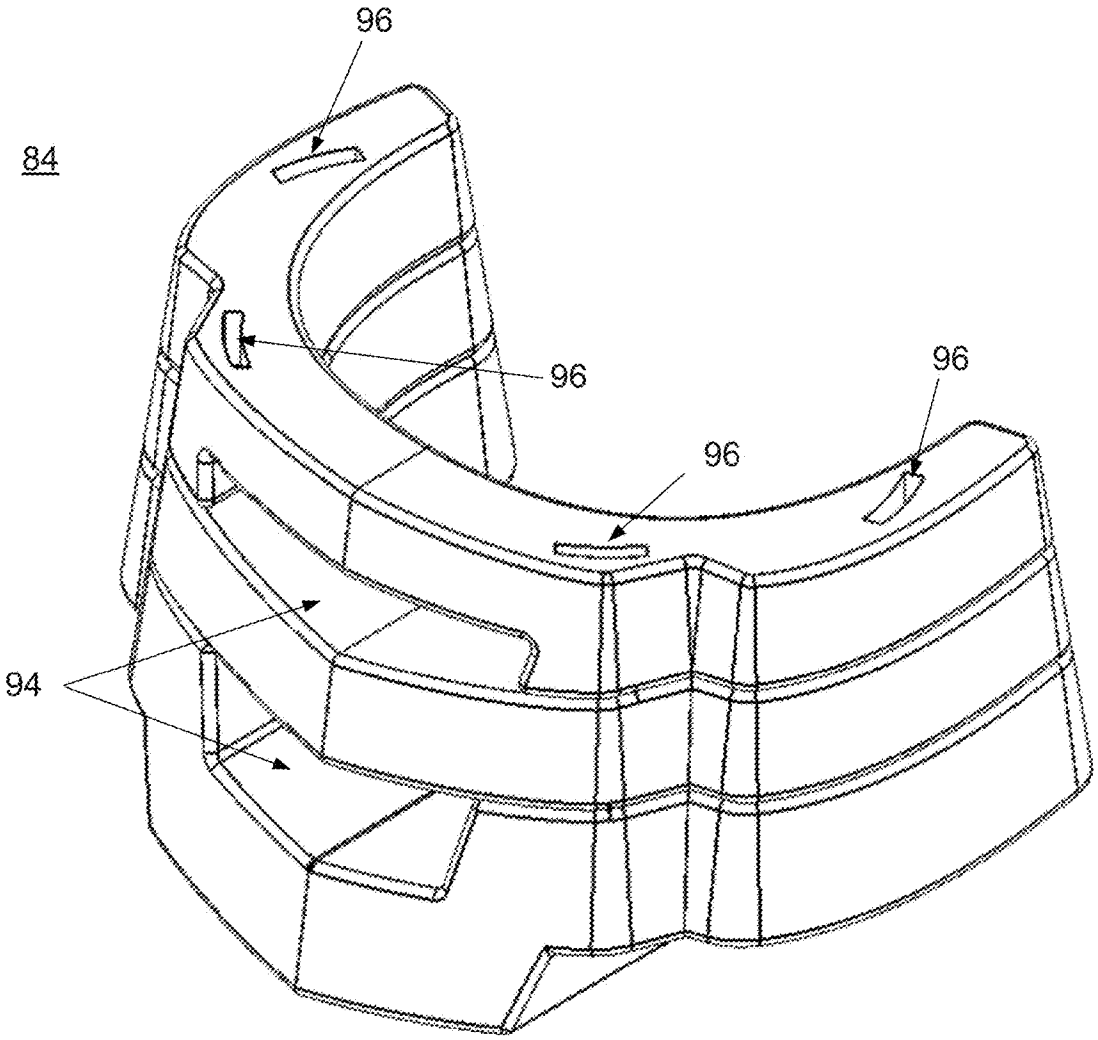
FIG. 28 schematically illustrates a view of a rear of the components of FIG. 27.
Figure 29:
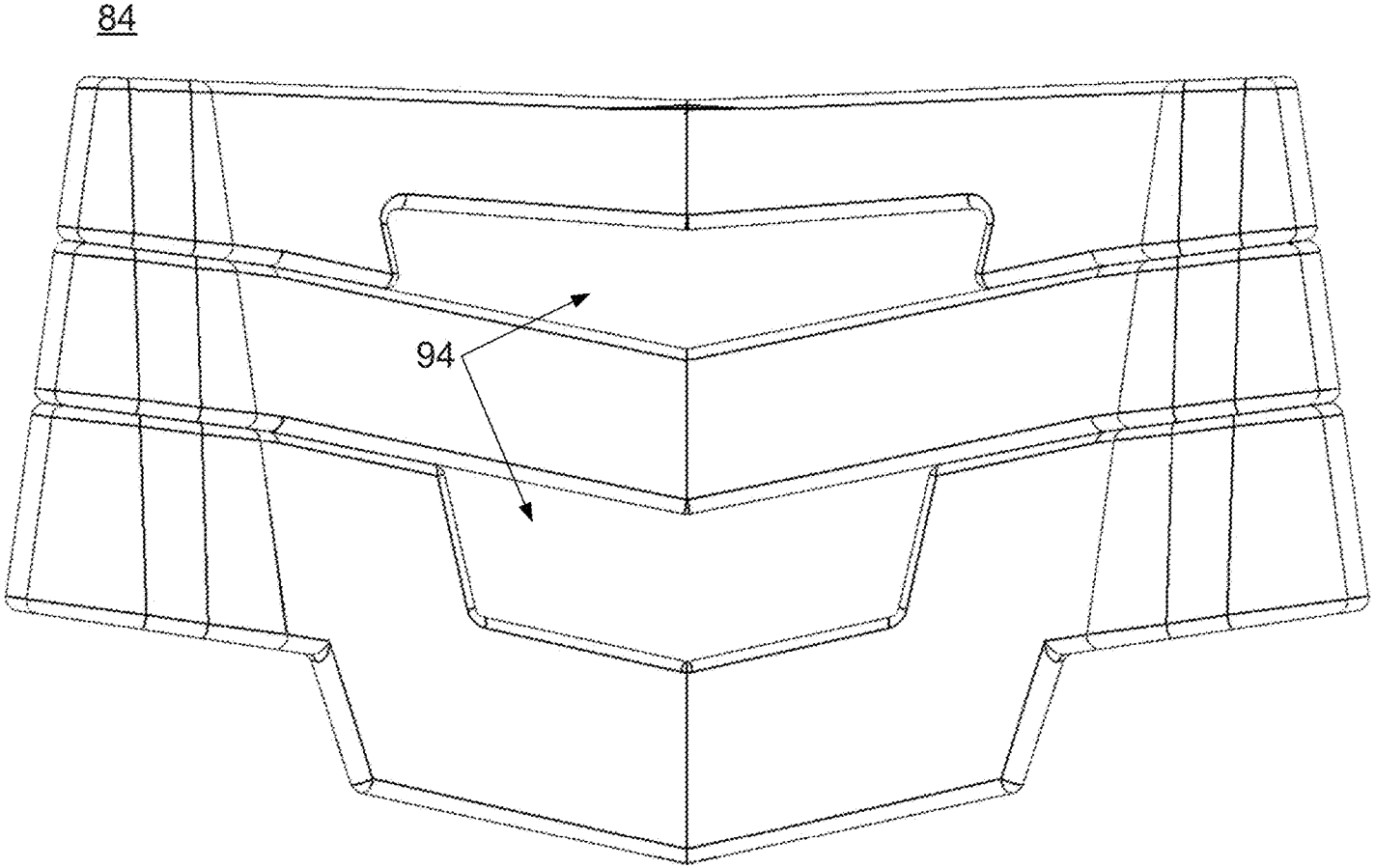
FIG. 29 schematically illustrates a front view of the components of FIG. 27.
Figure 30:
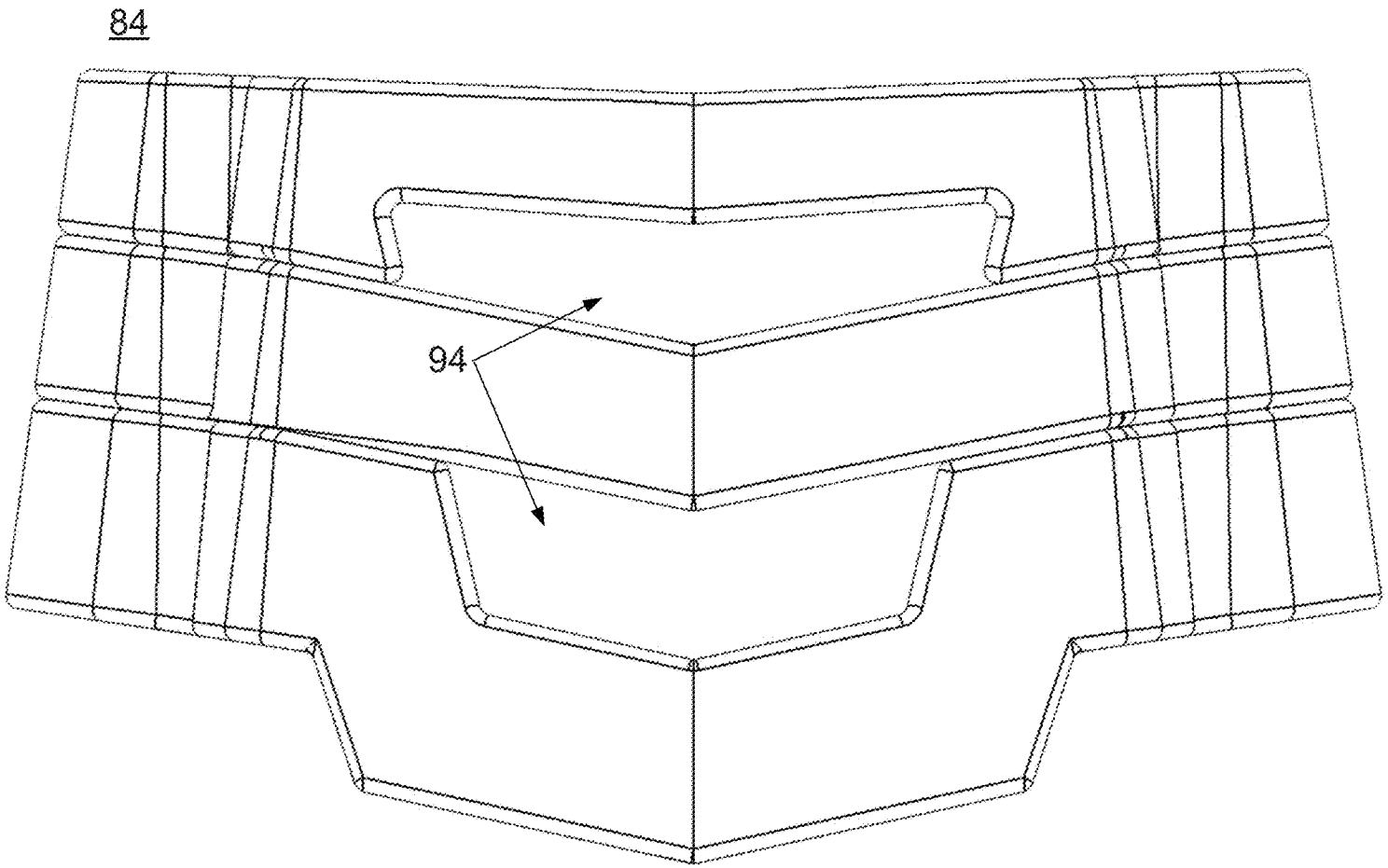
FIG. 30 schematically illustrates a rear view of the components of FIG. 27.

With further reference to the neck cushion 84, FIG. 27 schematically illustrates a view of a front of the neck cushion 84 of the safety apparatus 72. FIG. 28 schematically illustrates a view of a rear of the neck cushion 84; FIG. 29 schematically illustrates a front view of the neck cushion 84; and FIG. 30 schematically illustrates a rear view of the neck cushion 84. As illustrated in these drawings, the neck cushion 84 is comprised of three foam components that are arranged in a stacked orientation and preferably maintained in such stacked orientation by the tensioners 76,78,80,82 extending through slot openings 96 of the three foam components.

Figures 30A, 30B:
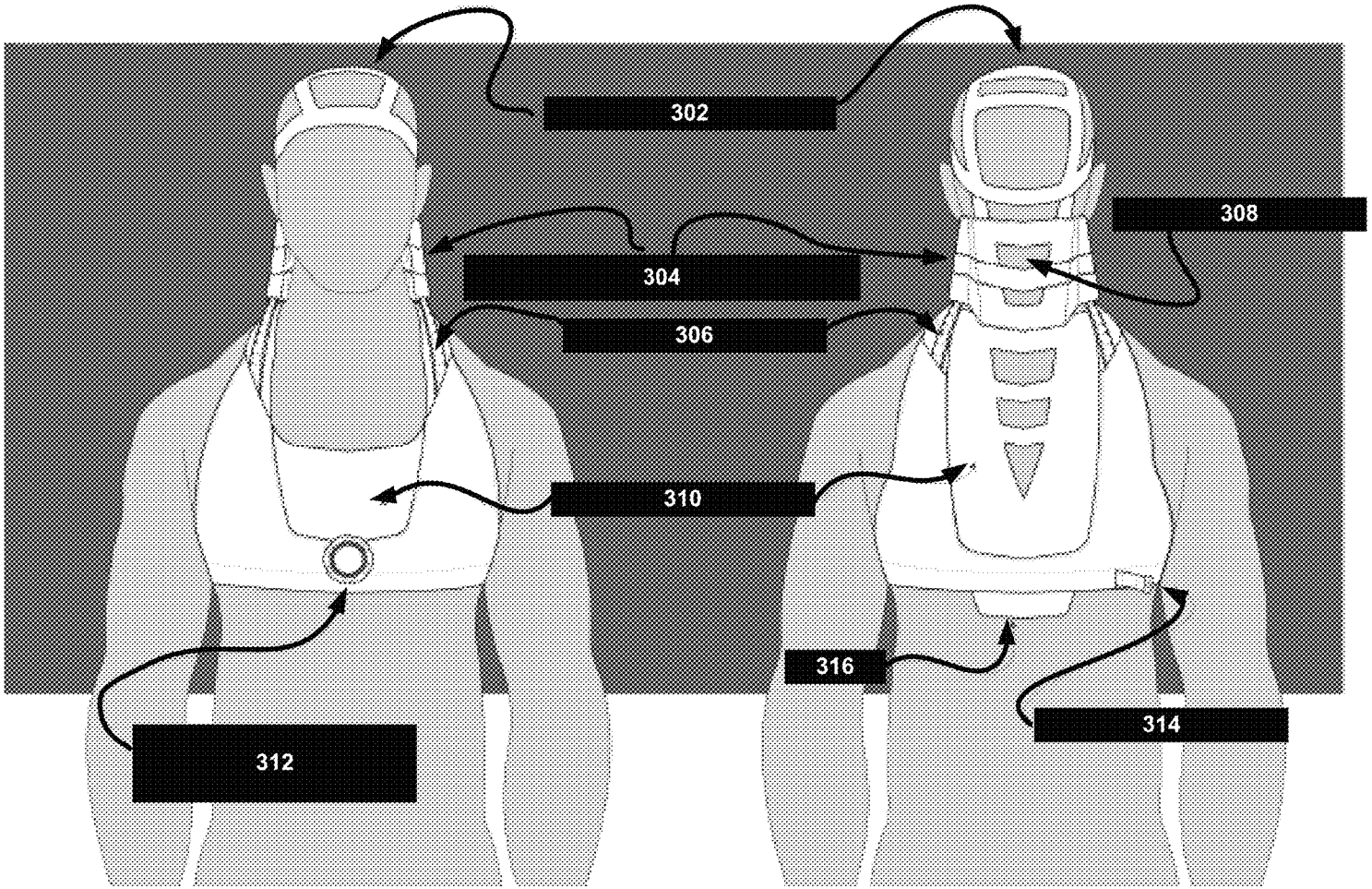
FIGS. 30*a* and 30*b* schematically illustrate another safety apparatus in accordance with one or more aspects and features of the present invention.

FIGS. 30*a* and 30*b* schematically illustrate another safety apparatus in accordance with one or more aspects and features of the present invention. The safety apparatus of FIGS. 30*a* and 30*b* includes a skull cap cradle 302; range-of-motion (ROM) limiting/force mitigating foam pads 304; ROM limiting member 306; force-mitigating spaces 308; a dri-fit breathable material 310; dual-direction ROM limiting member adjustment crank 312; a chest-tightening member 314; and an area 316 for branding. In the safety apparatus of FIGS. 30*a* and 30*b*, the head harness does not include a liner. Moreover, the vest includes a chest belt formed along the bottom edge portion of the vest. The safety apparatus of FIGS. 30*a* and 30*b* also includes a crank (sometimes referred to herein as a "dual direction ROM limiting member adjustment crank").

In addition to the foregoing, additional safety apparatus, systems, and methods in accordance with one or more aspects and features of the present invention are disclosed and described below and in FIGS. 30*c* through 58.

Figures 30C, 30D:
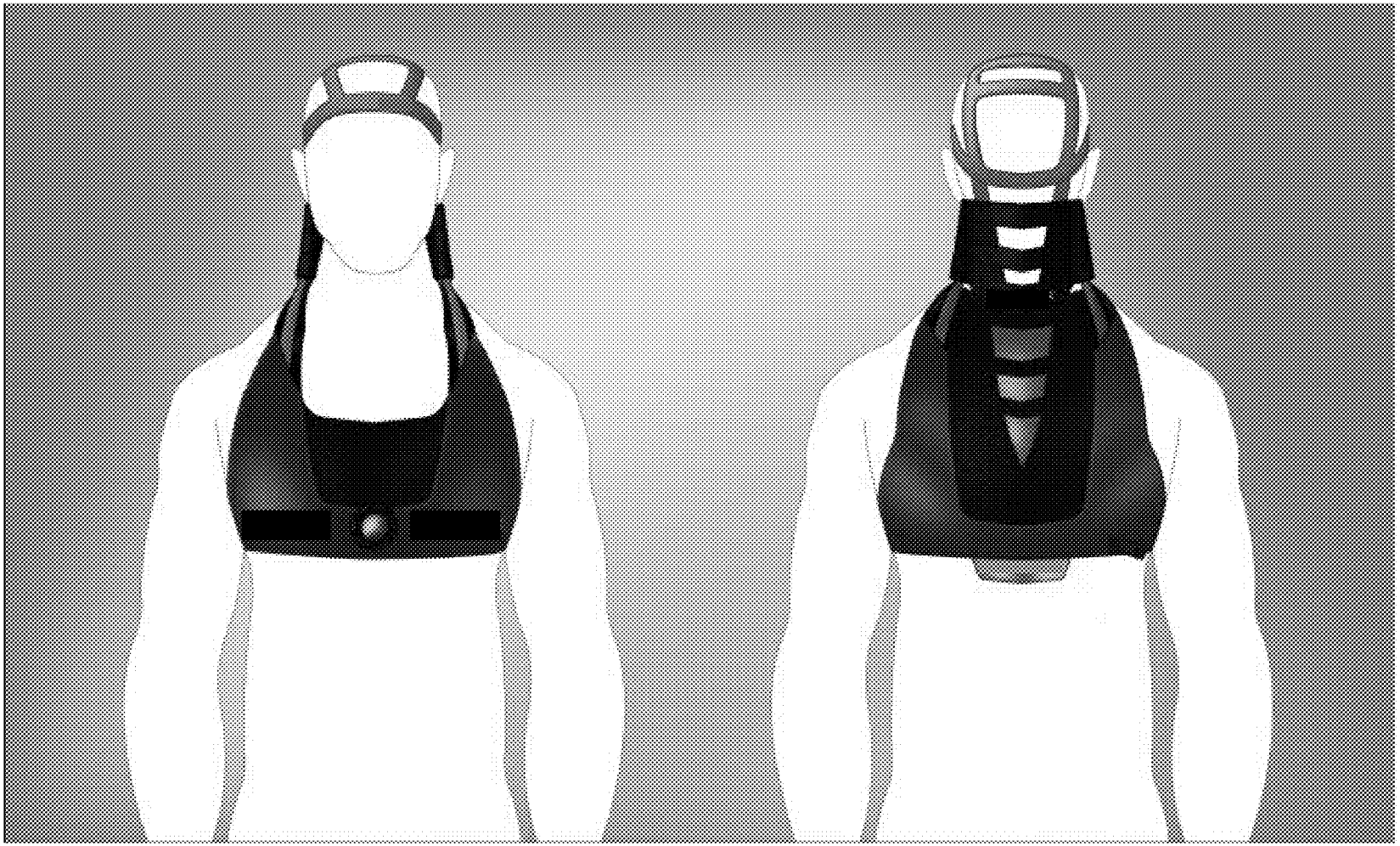
FIGS. 30*c* and 30*d* schematically illustrate another safety apparatus in accordance with one or more aspects and features of the present invention.

Specifically, FIGS. 30*c* and 30*d* schematically illustrate another safety apparatus in accordance with one or more aspects and features of the present invention.

Figures 30E, 30F:
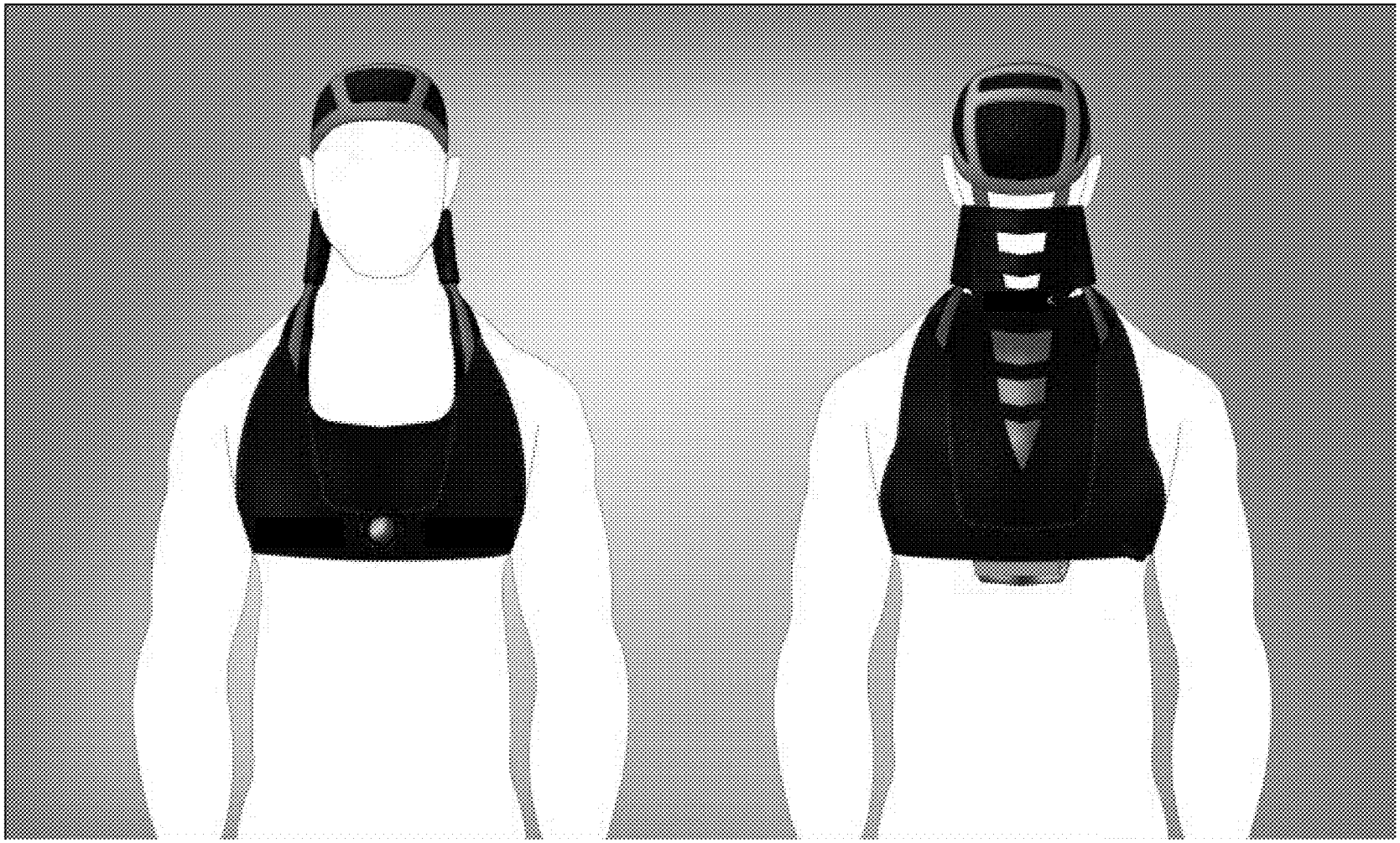
FIGS. 30*e* and 30*f* schematically illustrate another safety apparatus in accordance with one or more aspects and features of the present invention.

FIGS. 30*e* and 30*f* schematically illustrate another safety apparatus in accordance with one or more aspects and features of the present invention.

Figures 31, 32, 33:
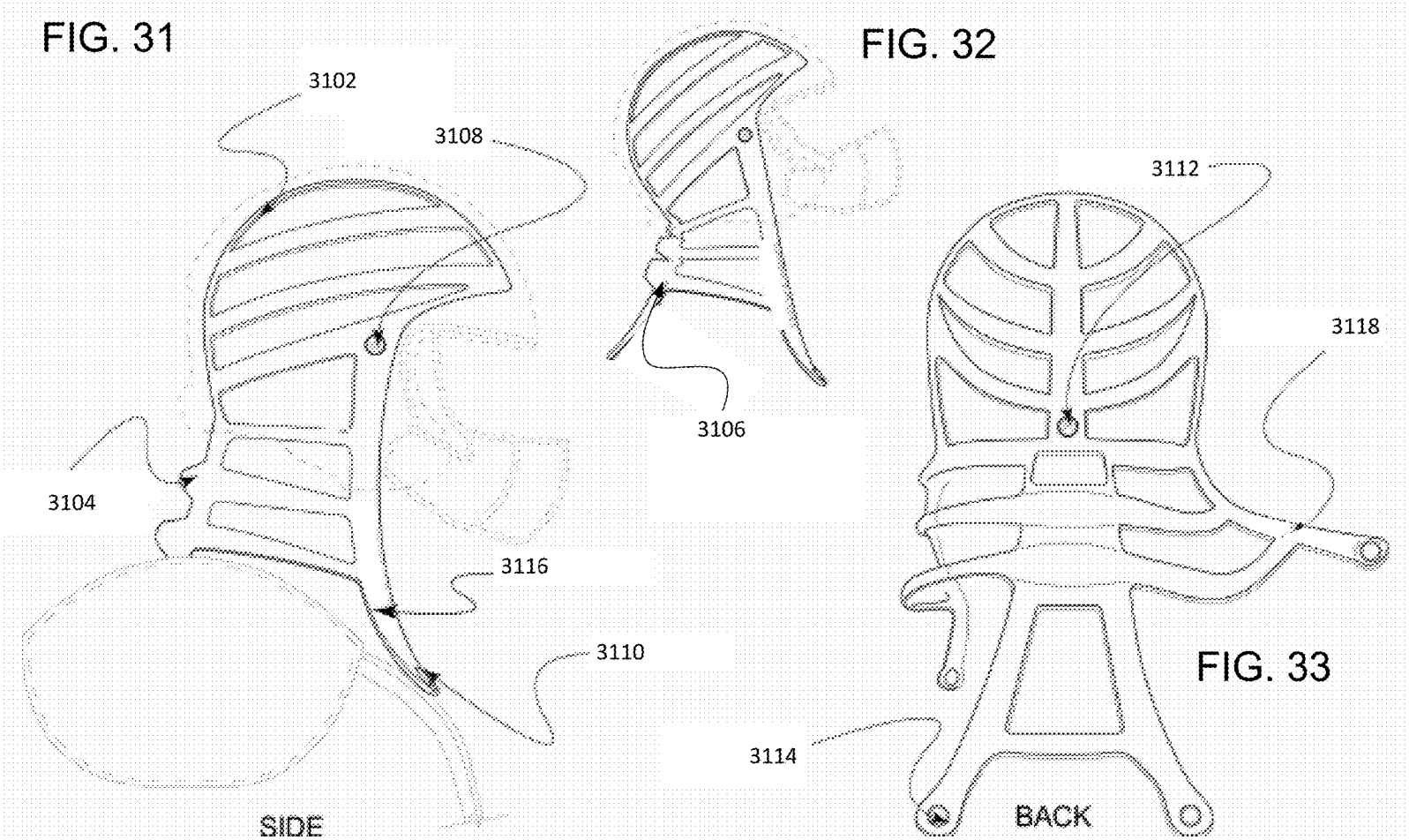
FIGS. 31-33 schematically illustrate components of a safety apparatus in accordance with one or more aspects and features of the present invention.

FIGS. 31-33 schematically illustrate components of a safety apparatus in accordance with one or more aspects and features of the present invention. This safety apparatus comprises a thin bodied, softer material indicated, for example, at 3102; a thicker bodied, rigid material as indicated, for example, at 3104, which when compressed serves as a collar to restrict neck movement as indicated at 3106; button snaps as indicated, for example, at 3108,3110,3112; button snaps for pads, as indicated for example, at 3114; and elastic members as indicated, for example, at 3116,3118.

Figure 35:
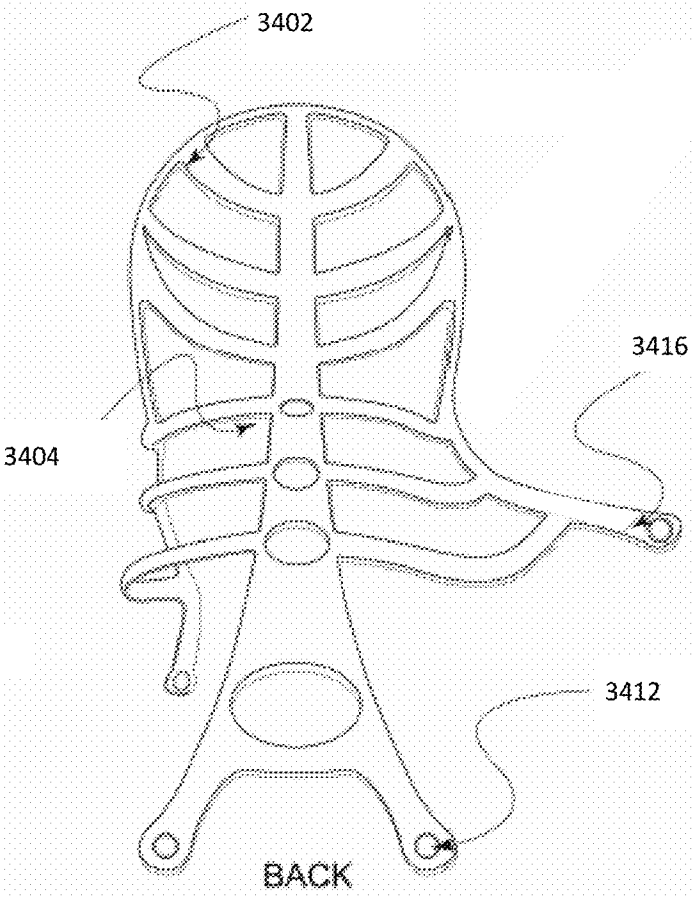
FIGS. 34-35 schematically illustrate components of a safety apparatus in accordance with one or more aspects and features of the present invention.
Figure 34:
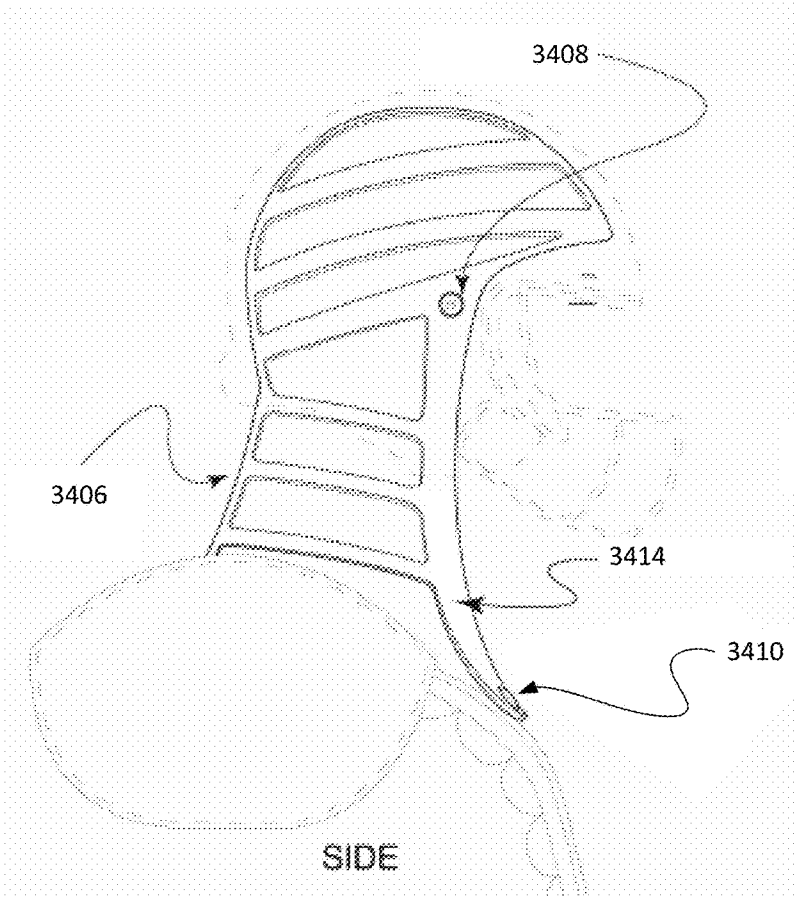

FIGS. 34-35 schematically illustrate components of a safety apparatus in accordance with one or more aspects and features of the present invention. The components comprise a thin bodied, softer material indicated, for example, at 3402; a thicker bodied, rigid material as indicated, for example, at 3404; button snaps as indicated, for example, at 3408,3410; button snaps for pads, as indicated for example, at 3412; and elastic members as indicated, for example, at 3414,3416. This safety apparatus requires the use of a collar at 3406.

Figure 36:
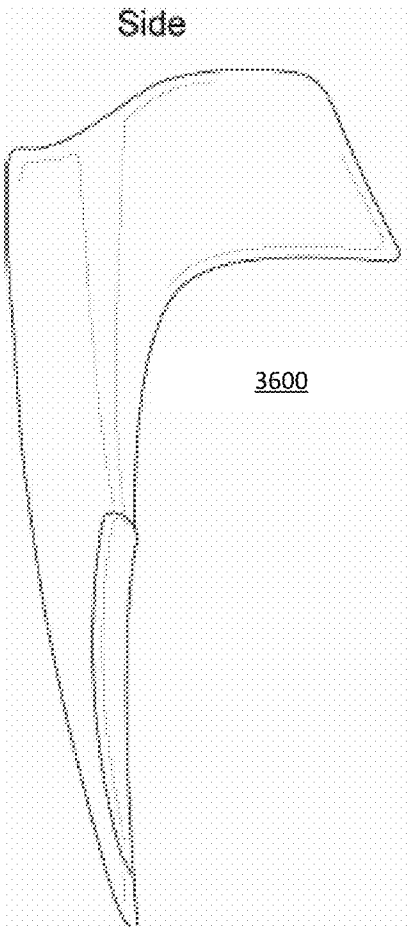
FIG. 36 schematically illustrates a side view of a component of a safety apparatus in accordance with one or more aspects and features of the present invention.

FIG. 36 schematically illustrates a side view of a back plate collar 3600 component of a safety apparatus in accordance with one or more aspects and features of the present invention, which includes shoulder pad anchor slots as indicated for example, at 3602.

Figure 37:
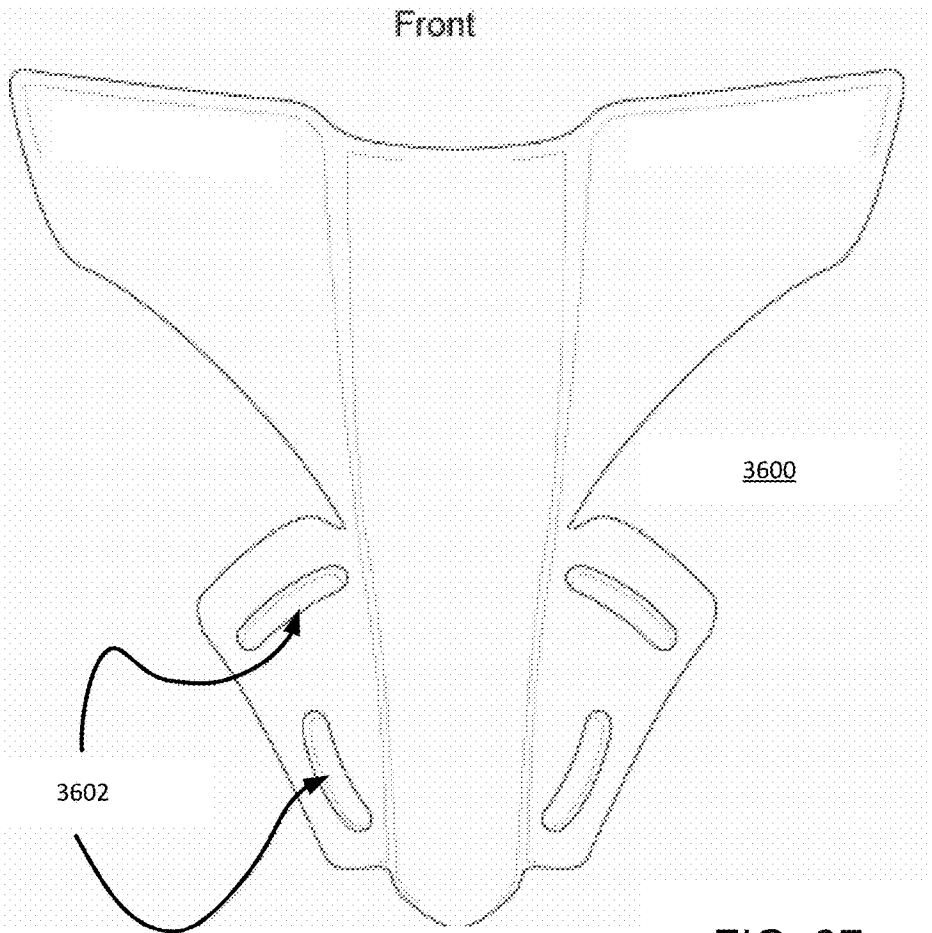
FIG. 37 schematically illustrates front view of the component of FIG. 36.
Figure 46:
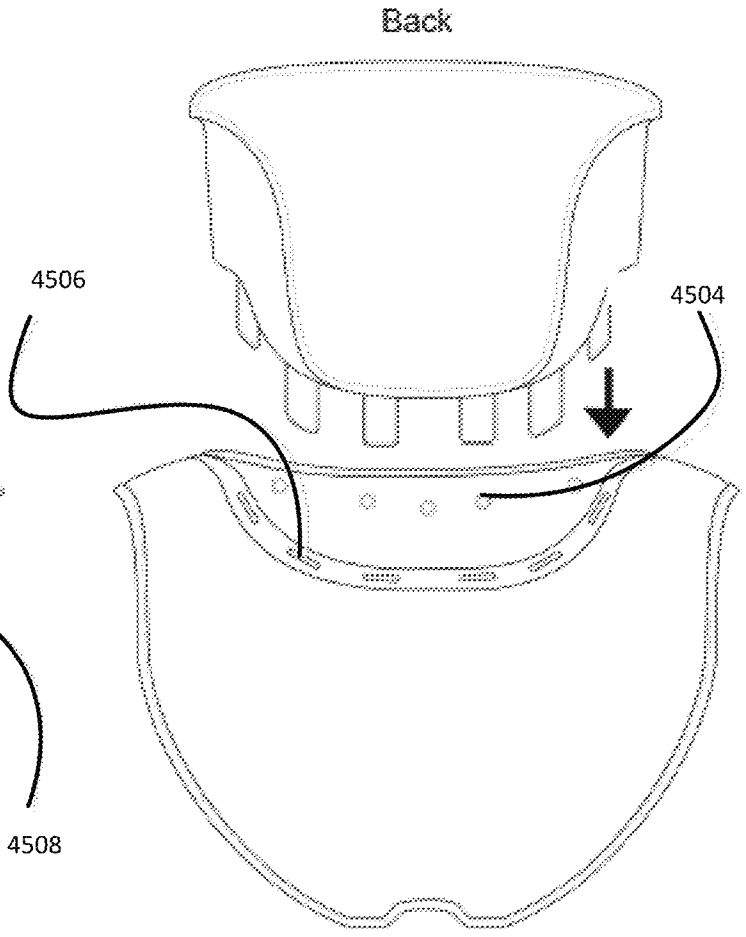

FIG. 37 schematically illustrates a front view of the component of FIG. 46.

Figures 38, 39, 40:
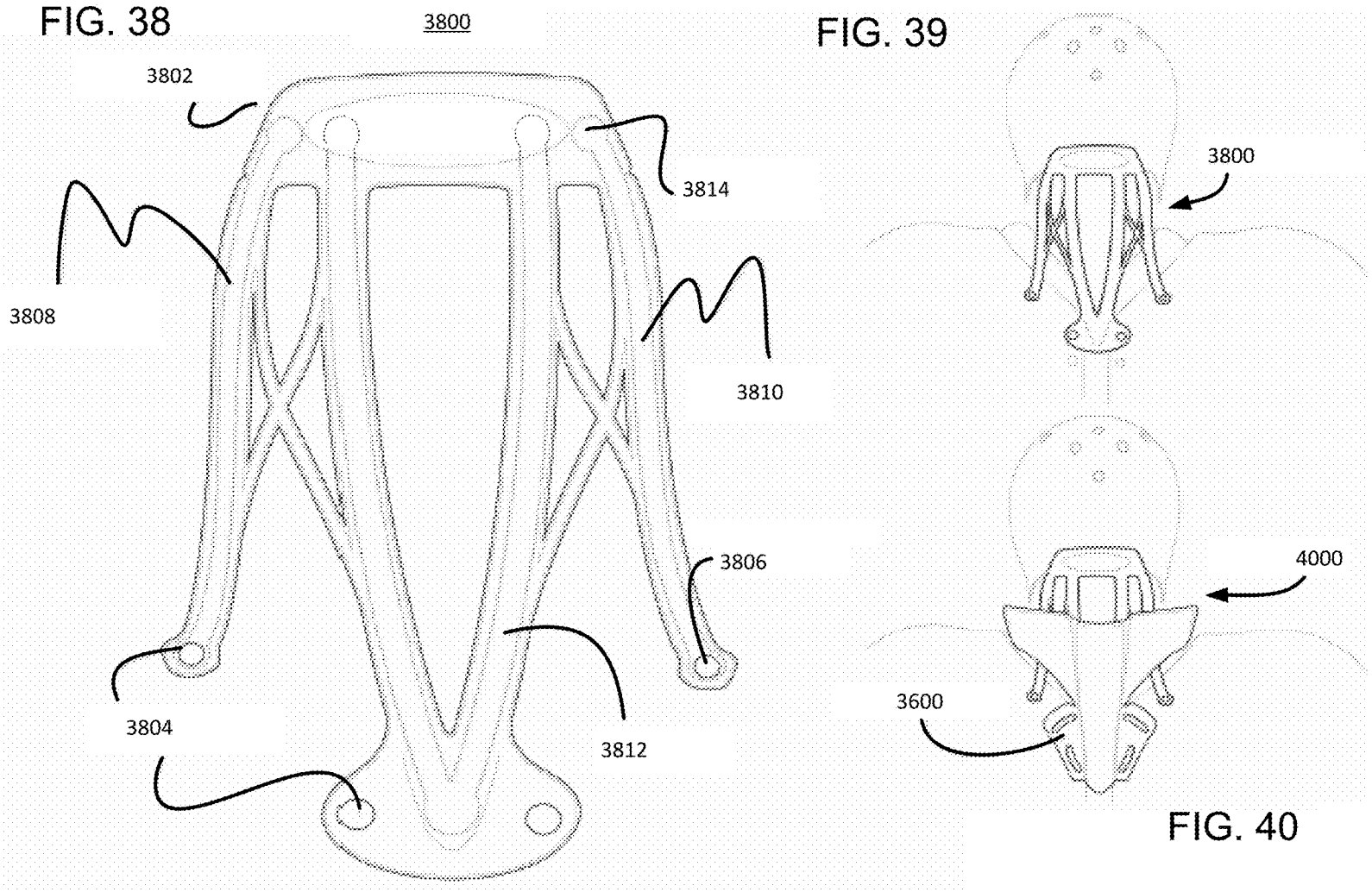
FIG. 38 schematically illustrates a front view of a component of a safety apparatus in accordance with one or more aspects and features of the present invention.
FIG. 39 schematically illustrates the component of FIG. 38 in use in accordance with one or more aspects and features of the present invention.
FIG. 40 schematically illustrates the combined use of the components of FIGS. 36-37 and 38 in accordance with one or more aspects and features of the present invention.

FIG. 38 schematically illustrates a front view of a component of a safety apparatus in accordance with one or more aspects and features of the present invention. This component includes rear inside helmet attachment points as indicated, for example, at 3802; rear shoulder pad anchor points as indicated, for example, at 3804,3806; force limiting members as indicated, for example, at 3808,3810,3812; and force limiting anchor points as indicated, for example, at 3814.

FIG. 39 schematically illustrates the strap assembly component 3800 of FIG. 38 in use in accordance with one or more aspects and features of the present invention.

FIG. 40 schematically illustrates the combined use of the components of FIGS. 36-37 and 38 in full assembly as indicated at 4000 in accordance with one or more aspects and features of the present invention.

Figures 41, 42:
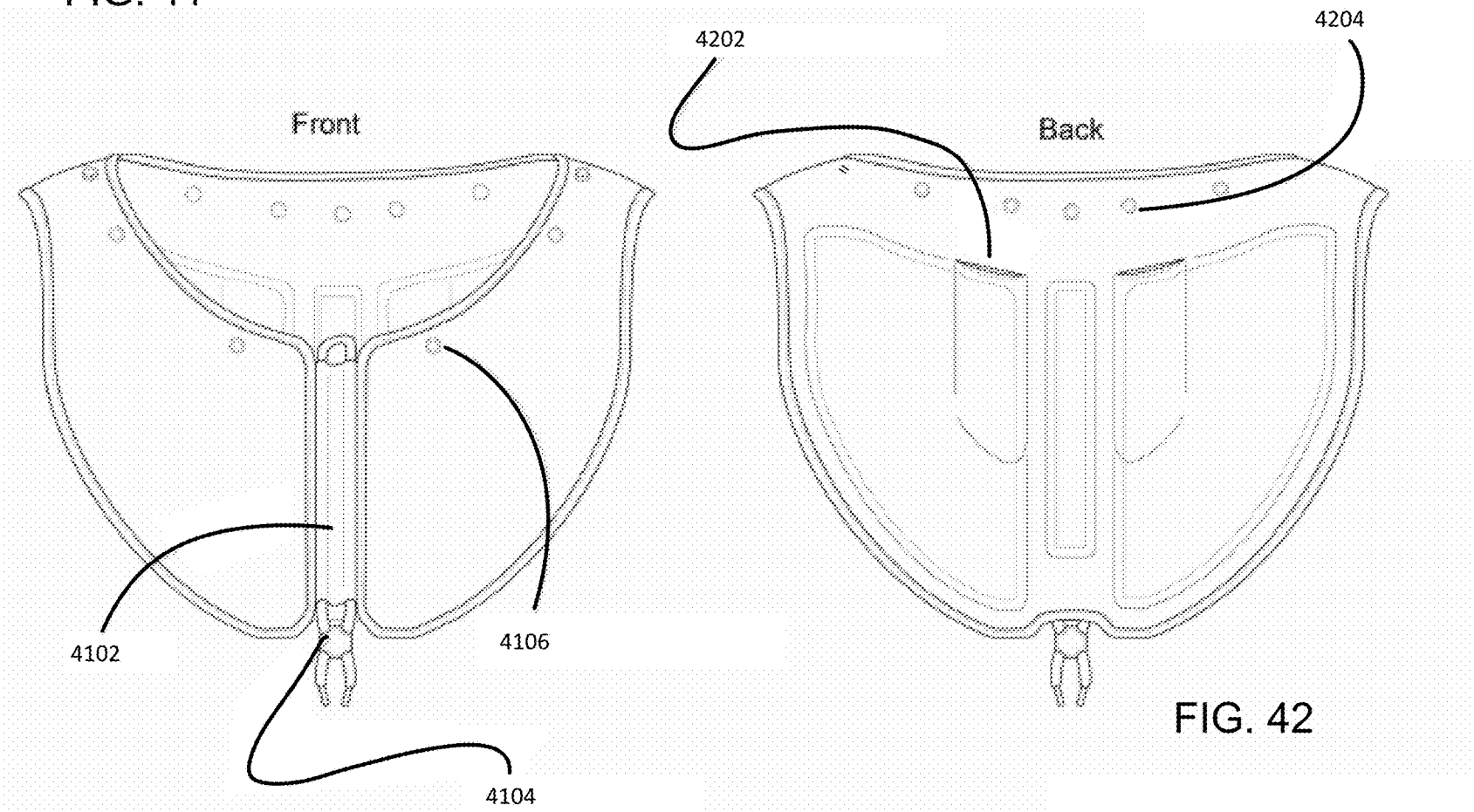
FIG. 41 schematically illustrates a front view of a component of a safety apparatus in accordance with one or more aspects and features of the present invention.
FIG. 42 schematically illustrates a back view of the component of FIG. 41.

FIG. 41 schematically illustrates a front view of a component of a safety apparatus in accordance with one or more aspects and features of the present invention, which includes elastic 4102; draw string tightener 4104; and mounting locations as indicated for example at 4106 for usage with or without a collar.

FIG. 42 schematically illustrates a back view of the component of FIG. 41, and shows slots as indicated for example at 4202 for mounting a collar, and mounting locations as indicated for example at 4204 for straps.

Figure 43:
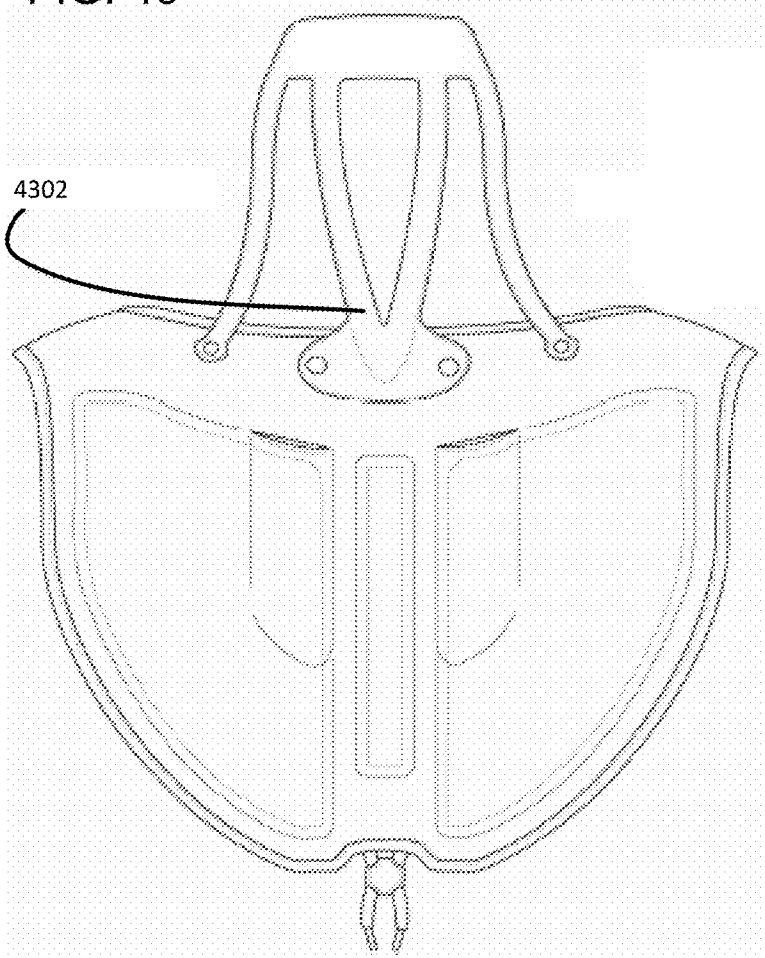
FIG. 43 schematically illustrates a back view of the component of FIG. 41 with an additional component (strap assembly) of a safety apparatus attached thereto.

FIG. 43 schematically illustrates a back view of the component of FIGS. 41 and 42 with an additional component (strap assembly 4302) of a safety apparatus attached thereto.

Figure 44:
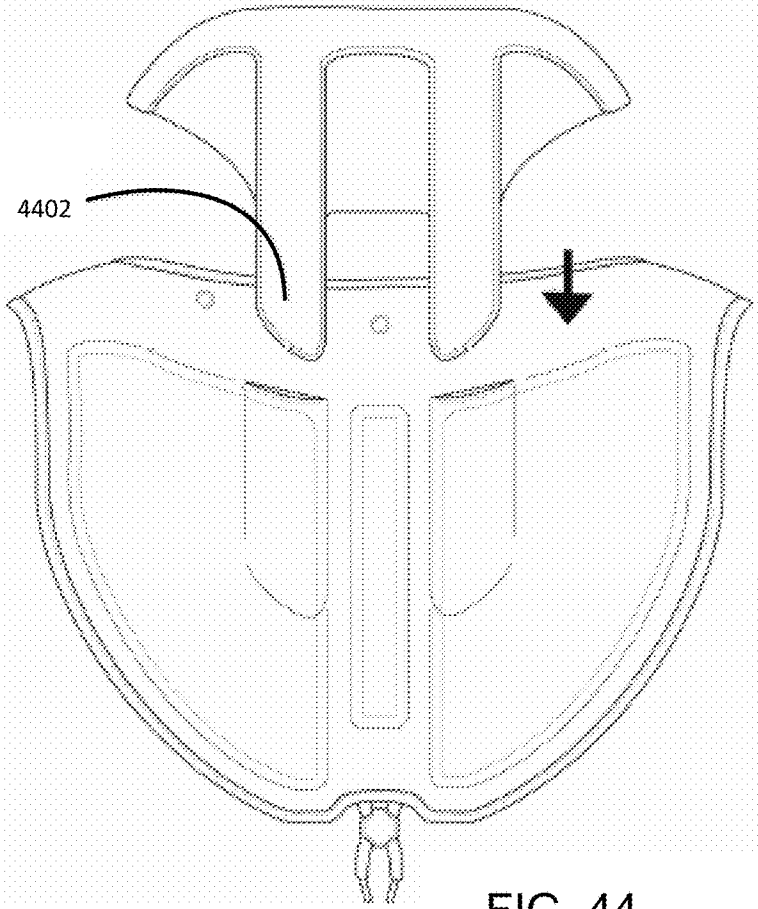
FIG. 44 schematically illustrates a back view of the component of FIG. 41 with an additional component (collar) of a safety apparatus being attached thereto.

FIG. 44 schematically illustrates a back view of the component of FIGS. 41 and 42 with an additional component (collar 4402) of a safety apparatus being attached thereto by pushing the collar down into the slots.

Figure 45:
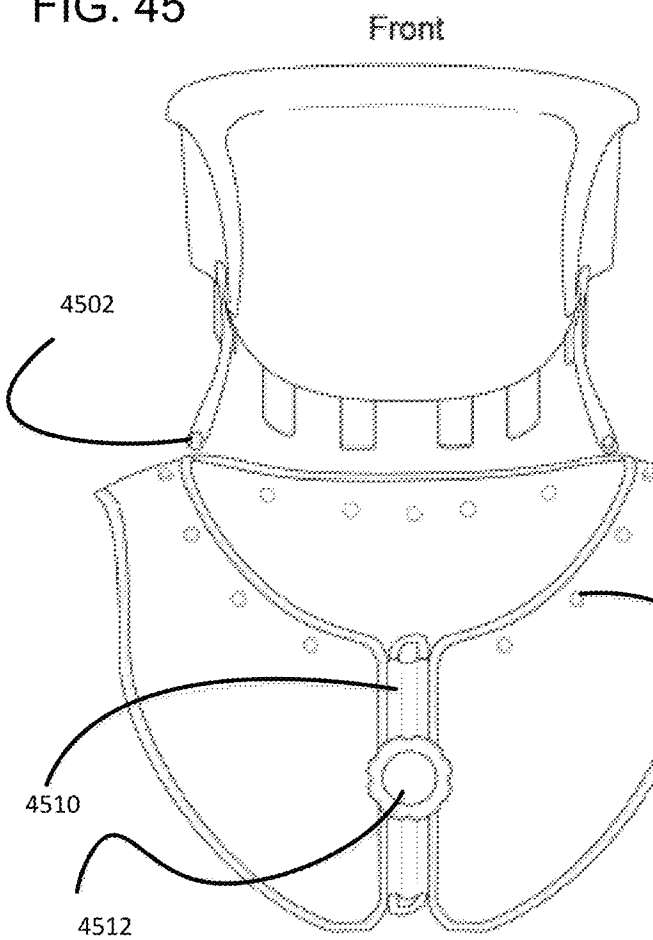
FIGS. 45-46 schematically illustrate front and back views, respectively, of components of a safety apparatus in accordance with one or more aspects and features of the present invention.

FIGS. 45-46 schematically illustrate front and back views, respectively, of components of a safety apparatus in accordance with one or more aspects and features of the present invention. This includes straps as indicated for example at 4502 for securing a collar; mounting locations as indicated for example at 4504 for the straps; slots as indicated for example at 4506 for mounting the collar; mounting locations for the collar as indicated for example at 4508; elastic 4510; and a bi-directional crank tightener 4512.

Figures 47, 48, 49:
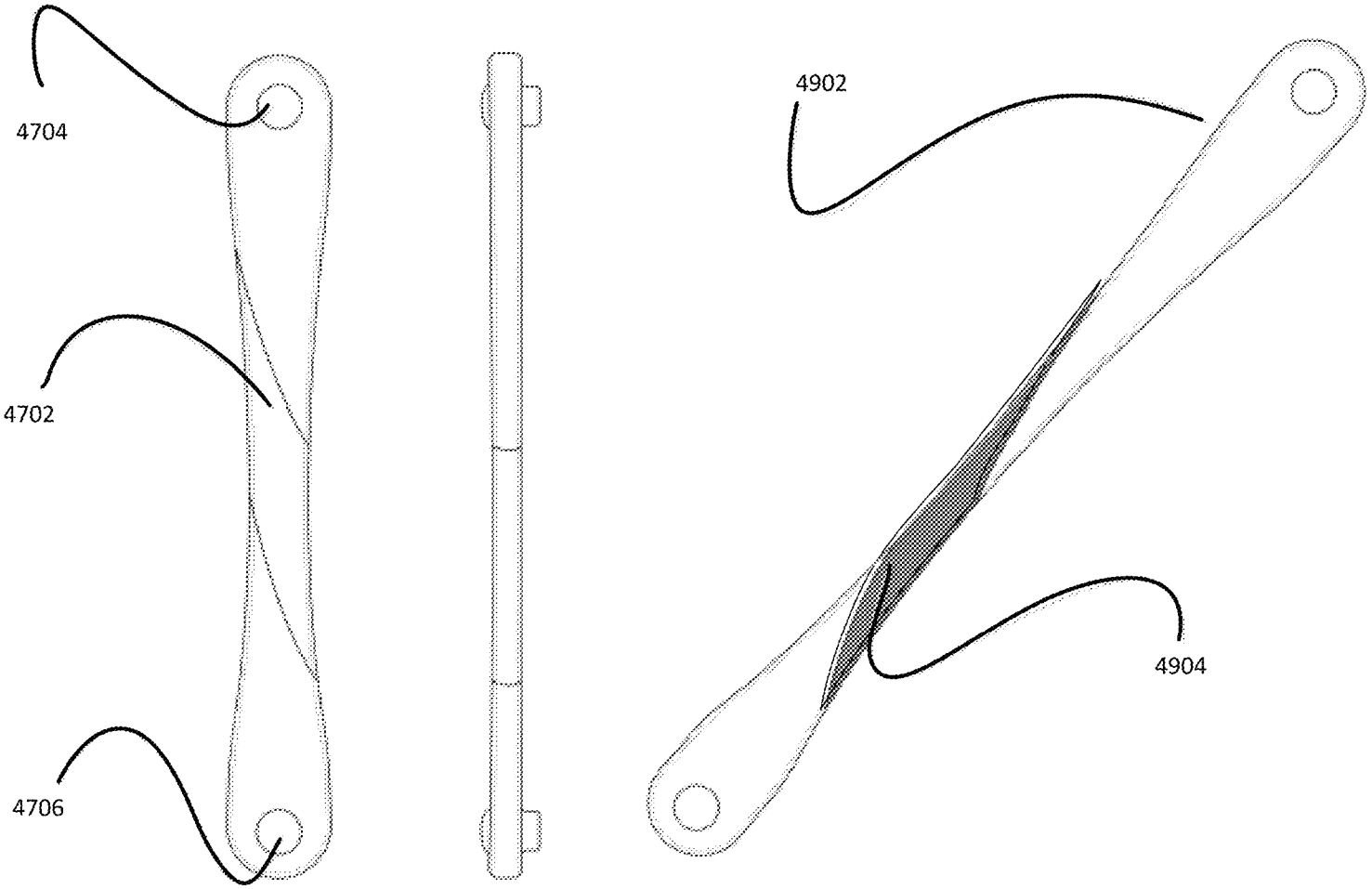
FIGS. 47-49 schematically illustrate a component (composite band) of a safety apparatus in accordance with one or more aspects and features of the present invention.

FIGS. 47-49 schematically illustrate a component (composite band) of a safety apparatus in accordance with one or more aspects and features of the present invention. This component includes a force limiting band 4702 and elastic bands as indicated, for example, at 4902. The elastic bands include a helmet attachment snap point indicated at 4704, and a shoulder pad snap anchor point indicated at 4706. The force limiting band is comprised of a material that changes color and thereby serves as a stress indicator after too much stress has been experienced. This is seen for example in FIG. 49 where maximum stress has occurred and the force limiting band has changed color (shown via shading at 4904). Furthermore, it will be appreciated that the force limiting band is longer in FIG. 49 than in FIGS. 47 and 48.

Figure 52:
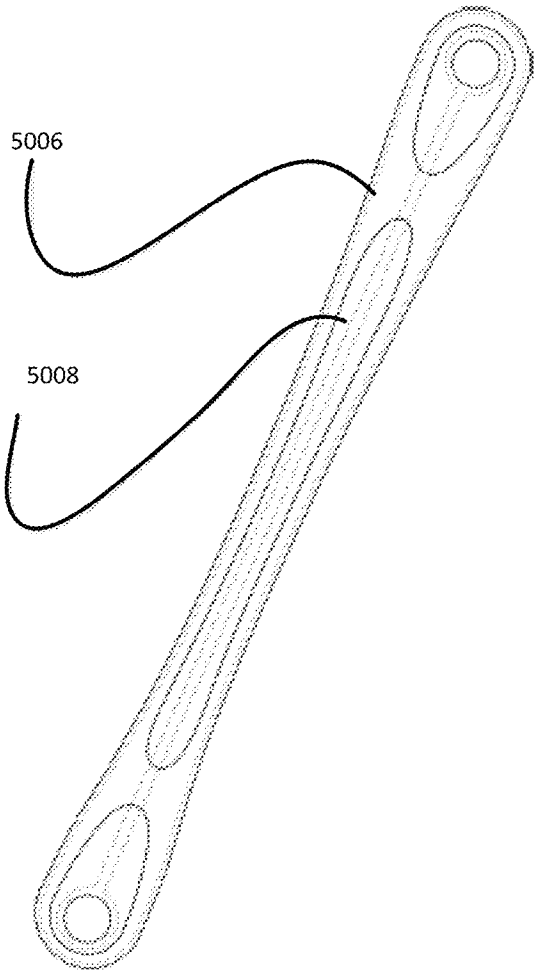
FIGS. 50-52 schematically illustrate a component (composite band) of a safety apparatus in accordance with one or more aspects and features of the present invention.
Figure 51:
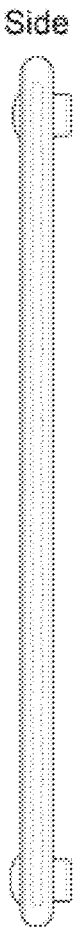
Figure 50:
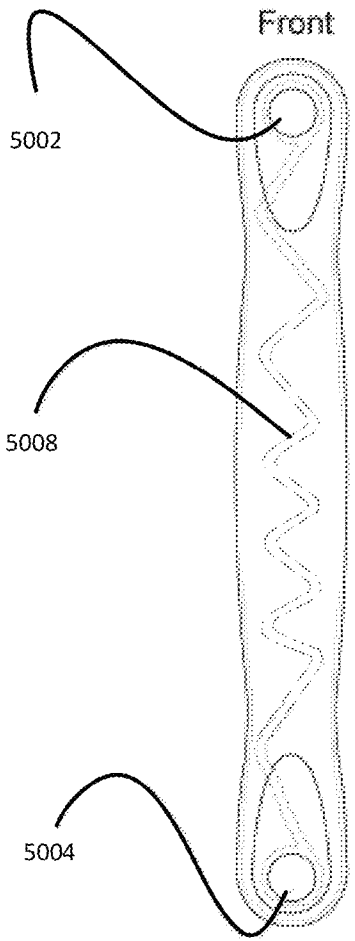

FIGS. 50-52 schematically illustrate a component (composite band) of a safety apparatus in accordance with one or more aspects and features of the present invention. The composite band comprises a helmet attachment snap point indicated at 5002, and a should pad snap anchor point indicated at 5004. The composite band further comprises an elastomeric band 5006 and a force limiting member 5008. The composite band is shown with a maximum stress on the force limiting band in FIG. 52.

Figures 53, 54, 55, 56:
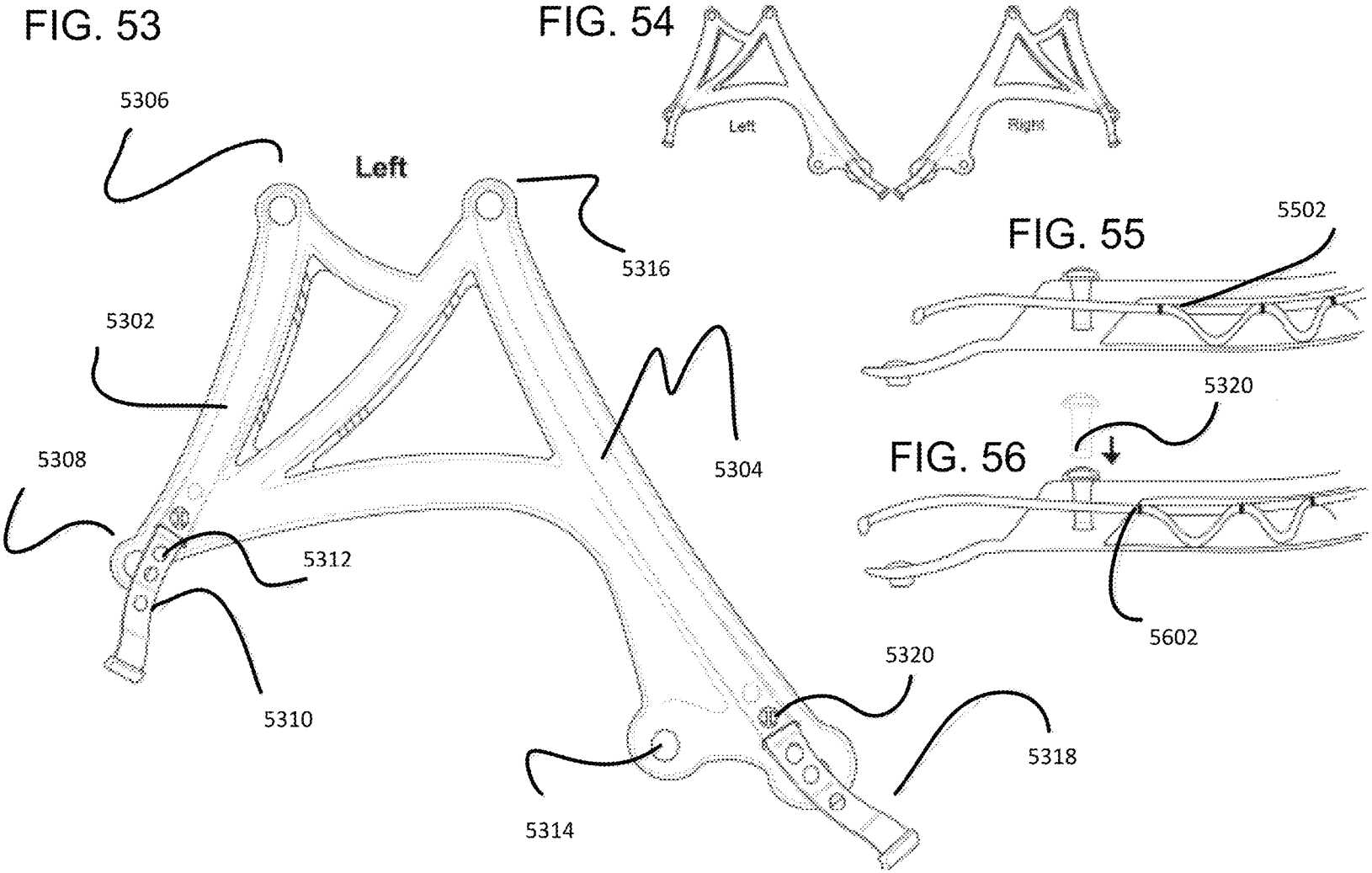
FIGS. 53-56 schematically illustrate components of a safety apparatus in accordance with one or more aspects and features of the present invention.

FIGS. 53-56 schematically illustrate components of a safety apparatus in accordance with one or more aspects and features of the present invention. Right and left components are seen in FIG. 54, whereas only the left component is seen in FIG. 53. With reference to FIG. 53, each component includes force limiting members 5302,5304; a front helmet attachment indicated for example at 5306; front shoulder pad anchor points indicated for example at 5308; a front size adjust indicated at 5310; adjustment slots indicated at 5312; rear shoulder pad anchor points indicated at 5314; rear helmet attachment indicated at 5316; a rear size adjust 5318; and an adjustment locking pin 5320. A maximum adjustment distance is represented in FIG. 56 at 5602. Additionally, FIG. 55 shows an elastic member and a rigid member indicated at 5702.

Figure 57:
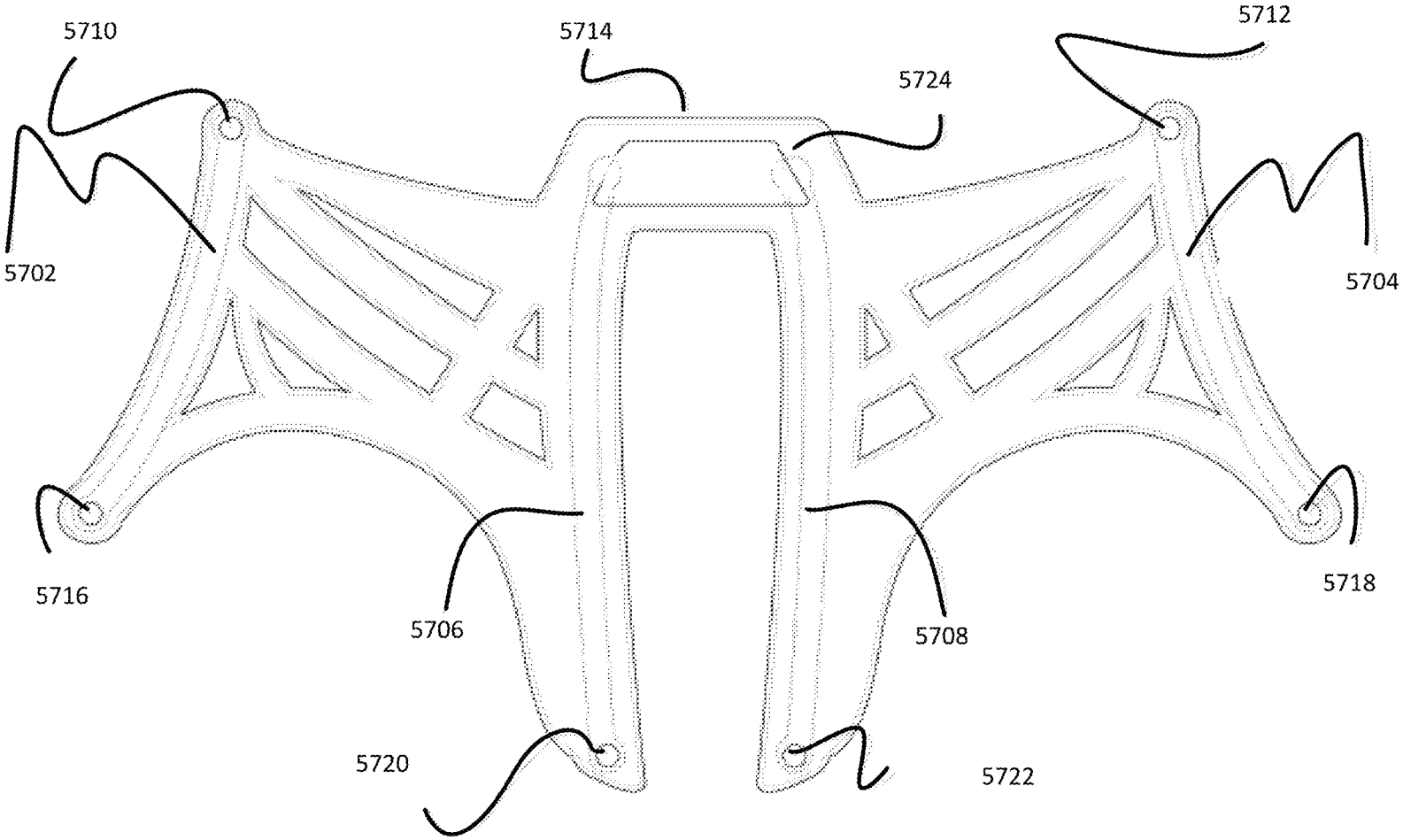
FIG. 57 schematically illustrate components of a safety apparatus in accordance with one or more aspects and features of the present invention.

FIG. 57 schematically illustrate components of a safety apparatus in accordance with one or more aspects and features of the present invention. This includes force limiting members 5702,5704,5706,5708; front helmet attachments 5710,5712; rear helmet attachment 5714; front shoulder pad anchor points 5716,5718; rear shoulder pad anchor points 5720,5722; and force limiting anchor points indicated for example at 5724.

Figure 58:
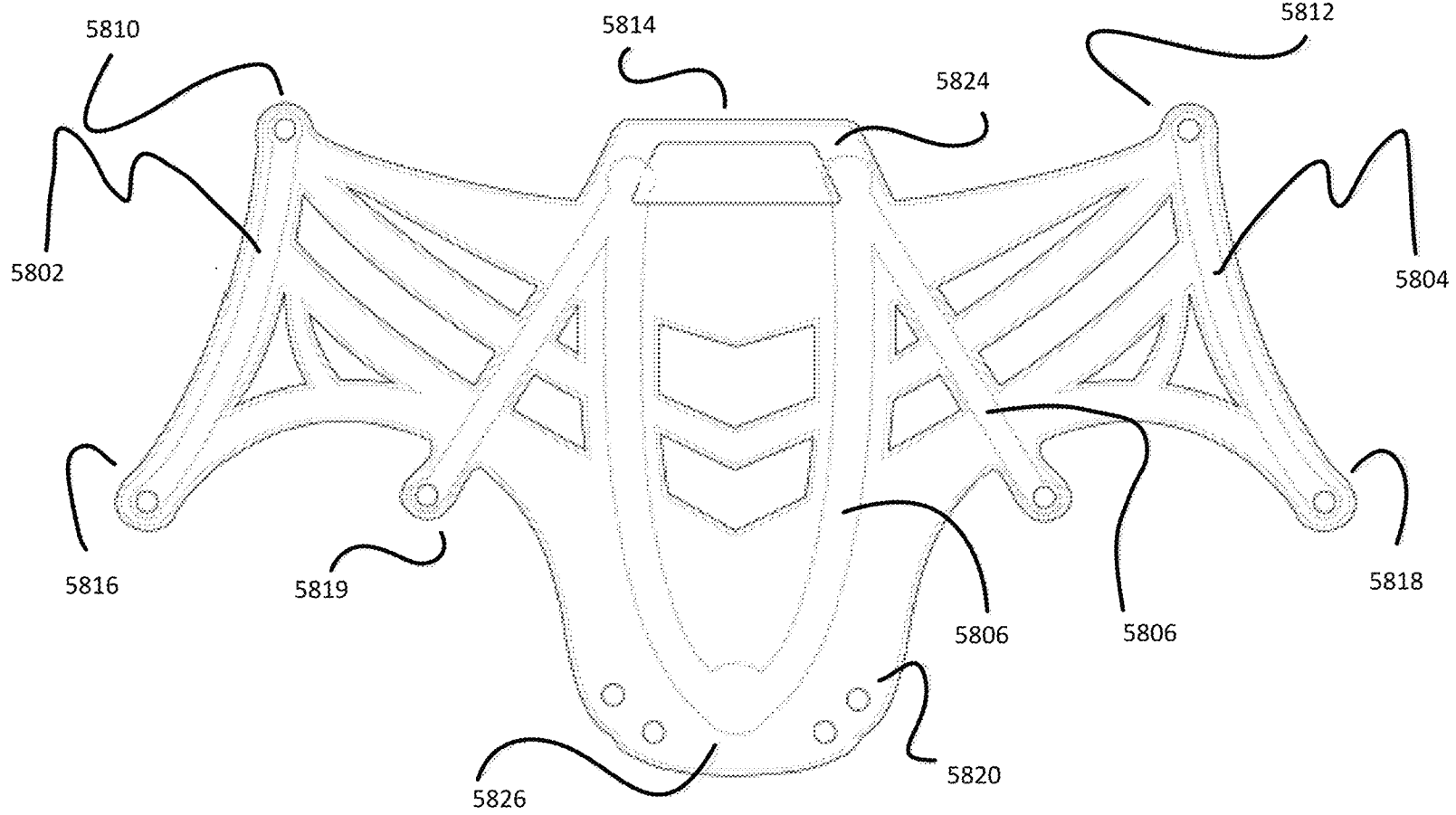
FIG. 58 schematically illustrates components of a safety apparatus in accordance with one or more aspects and features of the present invention.

FIG. 58 schematically illustrate components of a safety apparatus in accordance with one or more aspects and features of the present invention. This includes force limiting members 5802,5804,5806; front helmet attachments 5810,5812; rear helmet attachment 5814; front shoulder pad anchor points 5816,5818; additional shoulder pad anchor points indicated for example at 5819; rear shoulder pad anchor points indicated for example at 5820; and force limiting anchor points indicated for example at 5824,5826.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An apparatus for wearing by a person, comprising:

(a) a head harness for wearing on a head;

(b) a body anchor component for attachment to a torso;

(c) at least one tensioner extending between and interconnecting the head harness and the body anchor component, whereby the head harness is attached to the torso; and (d) a neck cushion for extending about a neck and located along the at least one tensioner between the body anchor and the head harness.

2. The apparatus of claim 1, wherein the neck cushion defines a slot configured to receive there through the at least one tensioner.

3. An apparatus for wearing by a person, comprising:

(a) a head harness for wearing on a head, the head harness including a skull cap for protecting the head and a liner separate from the skull cap for extending between the skull cap and the head;

(b) a body anchor component for attachment to a torso; and (c) at least one tensioner extending between and interconnecting the head harness and the body anchor component, whereby the head harness is attached to the torso.

4. The apparatus of claim 1, wherein the body anchor component comprises a chest belt.

5. The apparatus of claim 4, wherein the body anchor component comprises a vest; and wherein the at least one tensioner comprises at least three tensioners, a majority of each of which is covered by the vest and neck cushion and not susceptible to grabbing when the apparatus is worn.

6. An apparatus for wearing by a person, comprising:

(a) a head harness for wearing on a head;

(b) a body anchor component for attachment to a torso;

(c) at least one tensioner connected to and extending from the head harness;

(d) a neck cushion for extending about a neck and located along the at least one tensioner; and (e) a connecting component having viscoelastic characteristics that connects at least one tensioner to the body anchor component, whereby the head harness is attached to the torso.

7. The apparatus of claim 6, wherein the connecting component comprises a solid material having the viscoelastic characteristics by which the at least one tensioner is connected to the body anchor component.

8. The apparatus of claim 7, further comprising an inelastic strap or band overlapping the connecting component such that the inelastic strap or band permits a limited range of movement of the connecting component so as to preclude overloading of the connecting component.

9. The apparatus of claim 8, wherein an adjustable buckle directly connects the tensioner and the connecting component.

10. An apparatus for wearing by a person, comprising:

(a) a head harness for attachment to a head;

(b) a body anchor component for attachment to a torso;

(c) at least one tensioner extending between and interconnecting the head harness and the body anchor component;

(d) a neck cushion; and (e) a crank connected to the at least one tensioner for adjusting tension in the at least one tensioner, whereby the head harness is attached to the torso.

11. An apparatus for wearing by a person, comprising:

(a) a head harness for wearing on a head;

(b) a body anchor component for attachment to a torso;

(c) at least one tensioner extending between and interconnecting the head harness and the body anchor component; and (d) a neck cushion located along the at least one tensioner between the head harness and the body anchor component;

(e) wherein the at least one tensioner comprises an elastic band or strap combined with an inelastic band or strap.

12. The apparatus of claim 1, wherein the at least one tensioner comprises a composite strap or a composite band.

13. A sports safety apparatus for wearing by a person for limiting injuries to the head and neck while playing football, comprising:

(a) a cap for placement on a head of a football player;

(b) a neck cushion for extending about a neck of the football player; and (c) a vest for donning on the torso of the football player;

(d) wherein tensioners extend through slots defined in the neck cushion and interconnect the cap and vest such that the cap is attached to the vest and the neck cushion is secured between the cap and the vest, whereby tension is applied to the cap for limiting movement of the head to within a predefined range when the apparatus is worn by a person.

14. The apparatus of claim 13, wherein the at least one tensioner comprises an elastic band or strap combined with an inelastic band or strap.

15. The apparatus of claim 3, further comprising a neck cushion for extending about a neck and located along the at least one tensioner between the body anchor and the head harness.

16. The apparatus of claim 15, wherein the neck cushion defines a slot configured to receive there through the at least one tensioner, whereby the neck cushion is secured between the head harness and the body anchor component.

17. The apparatus of claim 1, wherein the head harness includes a skull cap for protecting the head and a liner separate from the skull cap for extending between the skull cap and the head.

18. The apparatus of claim 6, wherein the head harness includes a skull cap for protecting the head and a liner separate from the skull cap for extending between the skull cap and the head.

19. The apparatus of claim 10, wherein the head harness includes a skull cap for protecting the head and a liner separate from the skull cap for extending between the skull cap and the head.

20. The apparatus of claim 11, wherein the head harness includes a skull cap for protecting the head and a liner separate from the skull cap for extending between the skull cap and the head.

* * * * *